US011208847B2

(12) United States Patent
Azar et al.

(10) Patent No.: US 11,208,847 B2
(45) Date of Patent: Dec. 28, 2021

(54) STEPPED DOWNHOLE TOOLS AND METHODS OF USE

(71) Applicant: Smith International, Inc., Houston, TX (US)

(72) Inventors: Michael George Azar, The Woodlands, TX (US); Geoffrey Charles Downton, Stonehouse (GB); Edward George Parkin, Stonehouse (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 16/610,833

(22) PCT Filed: Apr. 24, 2018

(86) PCT No.: PCT/US2018/029000
§ 371 (c)(1),
(2) Date: Nov. 4, 2019

(87) PCT Pub. No.: WO2018/204123
PCT Pub. Date: Nov. 8, 2018

(65) Prior Publication Data

US 2020/0072000 A1 Mar. 5, 2020

Related U.S. Application Data

(60) Provisional application No. 62/501,841, filed on Apr. 24, 2018.

(51) Int. Cl.
*E21B 10/26* (2006.01)
*E21B 10/43* (2006.01)
(Continued)

(52) U.S. Cl.
CPC ..... *E21B 10/26* (2013.01); *E21B 7/061* (2013.01); *E21B 10/43* (2013.01); *E21B 17/1078* (2013.01); *E21B 47/00* (2013.01)

(58) Field of Classification Search
CPC ..... E21B 10/26; E21B 7/061; E21B 10/43; E21B 17/1078; E21B 47/00
See application file for complete search history.

(56) References Cited

U.S. PATENT DOCUMENTS 2,124,414 A * 7/1938 Goldman ..... E21B 10/083 175/334
2,607,562 A * 8/1952 Phipps ..... E21B 10/26 175/391
(Continued)

FOREIGN PATENT DOCUMENTS

CN 2890316 Y 4/2007
CN 203188914 U 9/2013
(Continued)

OTHER PUBLICATIONS

International Preliminary Report on Patentability issued in International Patent application PCT/US2018/029000, dated Nov. 5, 2019, 11 pages.
(Continued)

*Primary Examiner* — Nicole Coy

(57) ABSTRACT

A downhole tool includes at least a pilot section, a first expansion section, and a second expansion section. The pilot section has a plurality of cutting elements to cut a pilot hole. Each of the expansion sections has a plurality of cutting elements to successively expand the pilot hole to achieve a final wellbore radius. The pilot section, first expansion section, and second expansion section each have one or more stabilizer pads on respective gages to stabilize the downhole tool during wellbore creation.

19 Claims, 10 Drawing Sheets

(51) Int. Cl.

| | |
|---|---|
| ***E21B 17/10*** | (2006.01) |
| ***E21B 7/06*** | (2006.01) |
| ***E21B 47/00*** | (2012.01) |

(56) References Cited

U.S. PATENT DOCUMENTS

| | | | | |
|---|---|---|---|---|
| 3,138,213 | A | 6/1964 | Brandon | |
| 3,768,581 | A * | 10/1973 | Rederon | E21B 10/04 175/434 |
| 3,851,719 | A * | 12/1974 | Thompson | E21B 10/26 175/406 |
| 4,515,227 | A | 5/1985 | Cerkovnik | |
| 5,957,223 | A | 9/1999 | Doster et al. | |
| 5,992,547 | A | 11/1999 | Caraway et al. | |
| 5,992,548 | A | 11/1999 | Silva et al. | |
| 6,386,302 | B1 * | 5/2002 | Beaton | E21B 10/26 175/385 |
| 6,394,200 | B1 | 5/2002 | Watson et al. | |
| 6,412,579 | B2 | 7/2002 | Fielder | |
| 6,659,207 | B2 | 12/2003 | Hoffmaster et al. | |
| 6,729,420 | B2 | 5/2004 | Mensa-Wilmot | |
| 6,913,098 | B2 | 7/2005 | Fielder et al. | |
| 7,726,415 | B1 | 6/2010 | Tipton et al. | |
| 8,074,741 | B2 | 12/2011 | Meister | |
| 8,590,638 | B2 | 11/2013 | Downton | |
| 8,887,837 | B2 | 11/2014 | Azar et al. | |
| 2002/0112894 | A1 | 8/2002 | Caraway | |
| 2003/0178232 | A1 | 9/2003 | Mensa-Wilmot | |
| 2007/0029115 | A1 * | 2/2007 | Beaton | E21B 10/26 175/406 |
| 2009/0145667 | A1 | 6/2009 | Makkar et al. | |
| 2009/0223721 | A1 | 9/2009 | Dourfaye | |
| 2010/0006341 | A1 | 1/2010 | Downton | |
| 2010/0116556 | A1 | 5/2010 | Buske | |
| 2011/0005841 | A1 | 1/2011 | Wood et al. | |
| 2011/0100714 | A1 | 5/2011 | Moss et al. | |
| 2011/0240366 | A1 | 10/2011 | Hall et al. | |
| 2011/0240367 | A1 | 10/2011 | Guidry et al. | |
| 2014/0262536 | A1 | 9/2014 | Azar et al. | |
| 2015/0259988 | A1 | 9/2015 | Chen et al. | |
| 2015/0345228 | A1 | 12/2015 | Williams et al. | |
| 2016/0265281 | A1 | 9/2016 | Beaton et al. | |
| 2016/0376845 | A1 | 12/2016 | Chen | |

FOREIGN PATENT DOCUMENTS

| | | |
|---|---|---|
| CN | 203905815 U | 10/2014 |
| CN | 204225773 U | 3/2015 |
| CN | 105064921 A | 11/2015 |
| CN | 205349232 U | 6/2016 |

OTHER PUBLICATIONS

International Search Report and Written Opinion issued in International Patent application PCT/US2018/029000 dated Jul. 19, 2018, 16 pages.

Industry Continues to Advance Drill Bit Technology, Offshore online magazine, http://www.offshore-mag.com/articles/print/volume-74/issue-5/drilling-andcompletion/industry-continues-to-advance-drill-bit-technology.html, May 2, 2014, 8 pages.

Bit of Best Fit; Drilling Contractor, IADC, http://www.drillingcontractor.org/23877-23877, Sep. 10, 2013; 6 pages.

TP (TM) Series Hyper-Stable PDC Bits, Product Brochure, OTS International, Inc., Dec. 2014, 1 page.

DuoForce (TM) Bi-Center Drill Bits, Product Brochure, OTS International, Inc., Dec. 2014, 1 page.

Santos, Erick Slis Raggio (Petrobras), Goncalves, Clemente Jose De Castro (Petrobras), "How Hard Rocks Under High Stress Levels Do Behave Upon Drilling." Offshore Technology Conference Brasil, Oct. 29, 2013, pp. 1-14, OTC24407, Offshore Technology Conference, Rio de Janeiro, Brazil.

First Office Action and Search Report issued in Chinese Patent Application 201880035392.1 dated Nov. 26, 2020, 21 pages.

* cited by examiner

STEPPED DOWNHOLE TOOLS AND METHODS OF USE

CROSS-REFERENCE TO RELATED APPLICATIONS

This application claims priority to, and the benefit of, U.S. Patent Application No. 62/501,841, filed May 5, 2017, which is expressly incorporated herein by this reference in its entirety.

BACKGROUND

Wellbores may be drilled into a surface location or seabed for a variety of exploratory or extraction purposes. For example, a wellbore may be drilled to access fluids, such as liquid and gaseous hydrocarbons, stored in subterranean formations and to extract the fluids from the formations. Wellbores used to produce or extract fluids may be lined with casing around the walls of the wellbore. A variety of drilling methods may be utilized depending partly on the characteristics of the formation through which the wellbore is drilled.

During creation, maintenance, and closing of a wellbore, various materials may be removed by a downhole tool to extend, widen, or redirect the wellbore. For example, downhole tools remove earthen material to extend or widen the wellbore. Larger radius wellbores often require more time and resources to drill than smaller radius wellbores. Furthermore, larger radius downhole tools may require different geometries, junk slots, cutting element placements, and cooling considerations relative to smaller radius downhole tools.

SUMMARY

According to some embodiments of the present disclosure, a downhole tool includes a pilot section, a first expansion section longitudinally uphole of the pilot section, and a second expansion section longitudinally uphole of the first expansion section. The pilot section includes pilot cutting elements, as well as a pilot gage having at least a pilot stabilizer pad at a pilot radius. The first expansion section includes first expansion cutting elements, as well as a first expansion gage having a first expansion stabilizer pad at a first expansion radius that is greater than the pilot radius. The second expansion section includes second expansion cutting elements, as well as a second expansion gage having a second expansion stabilizer pad at a second expansion radius that is greater than the first expansion radius.

In the same or other embodiments, a drill bit includes a pilot section, a first expansion section, and a second expansion section, with the second expansion section coupled to the pilot and first expansion sections such that the first expansion section is longitudinally between the pilot section and the second expansion section. The pilot section includes a pilot stabilizer pad and pilot cutting elements that have a pilot cutting radius. The first expansion section has a first expansion stabilizer pad, as well as first expansion cutting elements on a first expansion surface. The first expansion cutting elements define a first expansion cutting radius greater than the pilot cutting radius. The second expansion section has second expansion cutting elements on a second expansion surface, which define a second expansion cutting radius greater than the first expansion cutting radius.

According to one or more embodiments, a method of removing material using a downhole tool includes removing material in a formation with a pilot section of the downhole tool to create a pilot hole having a pilot radius. The downhole tool is stabilized in the pilot hole with a pilot stabilizer pad positioned on a pilot gage of the pilot section. The pilot hole is expanded to a first expansion radius with a first expansion section of the downhole tool, and the downhole tool is stabilized with a first expansion stabilizer pad positioned on a first expansion gage of the first expansion section. The hole is further expanded from the first expansion radius to a second expansion radius with a second expansion section of the downhole tool, and such that the pilot radius is between 50% and 95%, 65% and 95%, 75% and 95%, or 80% and 90% of the second expansion radius.

In some embodiments, a pilot section of a drill bit or downhole tool includes a cone, nose, shoulder, and gage region. According to the same or other embodiments, a pilot radius or pilot cutting radius is between 70% and 95%, or between 85% and 90% of a second expansion radius or second expansion cutting radius. In one or more aspects that can be combined with any other aspect herein, a second expansion section may also include a second expansion stabilizing pad, and/or any one or more of a pilot stabilizing pad, first expansion stabilizing pad, or second expansion stabilizing pad may be tapered. Cutting elements of the pilot section, first expansion section, second expansion section, third or fourth expansion sections, or any of the foregoing, may include planar cutting elements, non-planar cutting elements, or combinations of planar and non-planar cutting elements.

This summary is provided to introduce a selection of concepts that are further described below in the detailed description. This summary is not intended to identify key or essential features of the claimed subject matter, nor is it intended to be used as an aid in limiting the scope of the claimed subject matter. Rather, additional features of embodiments of the disclosure will be set forth in the description which follows, and in part will be obvious from the description, or may be learned by the practice of such embodiments. Some features and aspects of such embodiments may be realized and obtained by means of the instruments and combinations particularly pointed out in the appended claims. These and other features will become more fully apparent from the following description and appended claims, or may be learned by the practice of such embodiments as set forth hereinafter.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, other drawings should be considered as drawn to scale for some illustrative embodiments, but not to scale for other embodiments. Understanding that the drawings depict some example embodiments, the embodiments will be described and explained with additional specificity and detail through the use of the accompanying drawings in which:

FIG. 11-1 is a perspective view of a ridge cutting element, according to at least one embodiment of the present disclosure;

FIG. 11-2 is a side view of the ridge cutting element of FIG. 11-1;

FIGS. 13-1 to 13-3 are side views of cutting elements at varying back rake angles, according to at least one embodiment of the present disclosure;

FIGS. 15-1 to 16-3 are various views of cutting elements having varying side rake angles, according to at least one embodiment of the present disclosure.

DETAILED DESCRIPTION

Embodiments of the present disclosure generally relate to devices, systems, and methods for creating a wellbore in an earth formation. More particularly, some embodiments of the present disclosure relate to drill bits having a pilot section and a plurality of expansion sections that successively increase a wellbore radius. In some embodiments, a drill bit may increase a rate of penetration of the bit within formation, reduce the likelihood of a cutting element and/or a bit body failure, increase bit stability by decreasing lateral and/or axial vibration, or combinations thereof. While a drill bit for cutting through an earth formation is described herein, it should be understood that the present disclosure may be applicable to other cutting bits such as milling bits, fixed and expandable reamers, hole openers, and other cutting bits, and through other materials, such as cement, concrete, metal, or formations including such materials.

Figure 1:
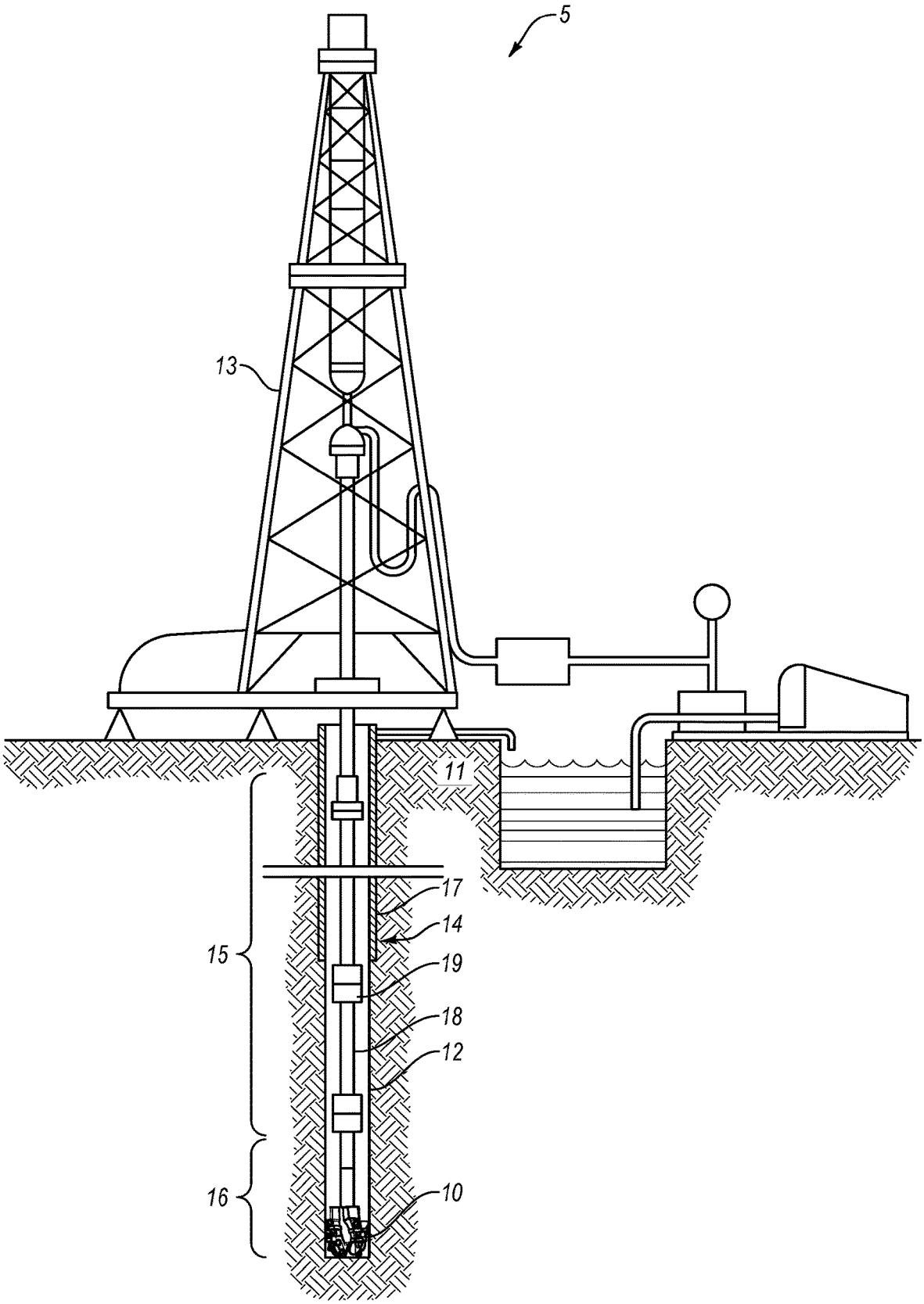
FIG. 1 is a schematic view of a drilling system including a downhole tool, according to at least one embodiment of the present disclosure.

FIG. 1 shows one example of a drilling system 5 for drilling an earth formation 11 to form a wellbore 12. The drilling system 5 includes a drill rig 13 used to turn a drilling tool assembly 14, which extends downward into the wellbore 12. The drilling tool assembly 14 in FIG. 1 includes a drill string 15, a bottomhole assembly ("BHA") 16, and a bit 11, attached to the downhole end of the drill string 15.

The drill string 15 may include several joints of drill pipe 18 a connected end-to-end through tool joints 19. The drill string 15 optionally transmits drilling fluid through a central bore, and may transmit rotational power from the drill rig 13 to the BHA 16, or from a downhole motor to all or a portion of the BHA 16. The drill pipe 18 provides a hydraulic passage through which drilling fluid is pumped from the surface. The drilling fluid discharges through selected-size nozzles, jets, or other orifices in the bit 10 for the purposes of cooling the bit 10 and cutting structures thereon, and for lifting cuttings out of the wellbore 12 as it is being drilled. In some embodiments, the drill string 15 further includes one or more additional components such as subs, pup joints, drill collars, jars, measurement or logging tools, vibrational conveyance tools, etc. In further embodiments, the drill string 15 includes coiled tubing, wireline tools, or other components rather, or in addition to, the drill pipe 18.

The BHA 16 may include the bit 10 or other components. An example BHA 16 includes additional or other components (e.g., coupled between to the drill string 15 and the bit 10). Examples of additional BHA components include drill collars, stabilizers, measurement-while-drilling ("MWD") tools, logging-while-drilling ("LWD") tools, downhole motors, underreamers, section mills, hydraulic disconnects, jars, vibration or dampening tools, other components, or combinations of the foregoing.

In general, the drilling system 5 may include other drilling components and accessories, such as special valves (e.g., kelly cocks, blowout preventers, and safety valves). Additional components included in the drilling system 5 may be considered a part of the drilling tool assembly 14, the drill string 15, or the BHA 16 depending on their location or function in the drilling system 5.

The bit 10 in the BHA 16 may be any type of bit suitable for degrading downhole materials. For instance, the bit 10 may be a drill bit suitable for drilling the earth formation 11. Example types of drill bits used for drilling earth formations are fixed-cutter or drag bits. In other embodiments, the bit 10 may be a mill used for removing metal, composite, elastomer, other downhole materials, or combinations thereof. For instance, the bit 10 may be used with a whipstock or other diverter to mill into the casing 17 lining the wellbore 12. The bit 10 may also be a junk mill used to mill away tools, plugs, cement, other materials within the wellbore 12, or combinations thereof. Swarf or other cuttings formed by use of a mill may be lifted to surface, or may be allowed to fall downhole.

Figure 2:
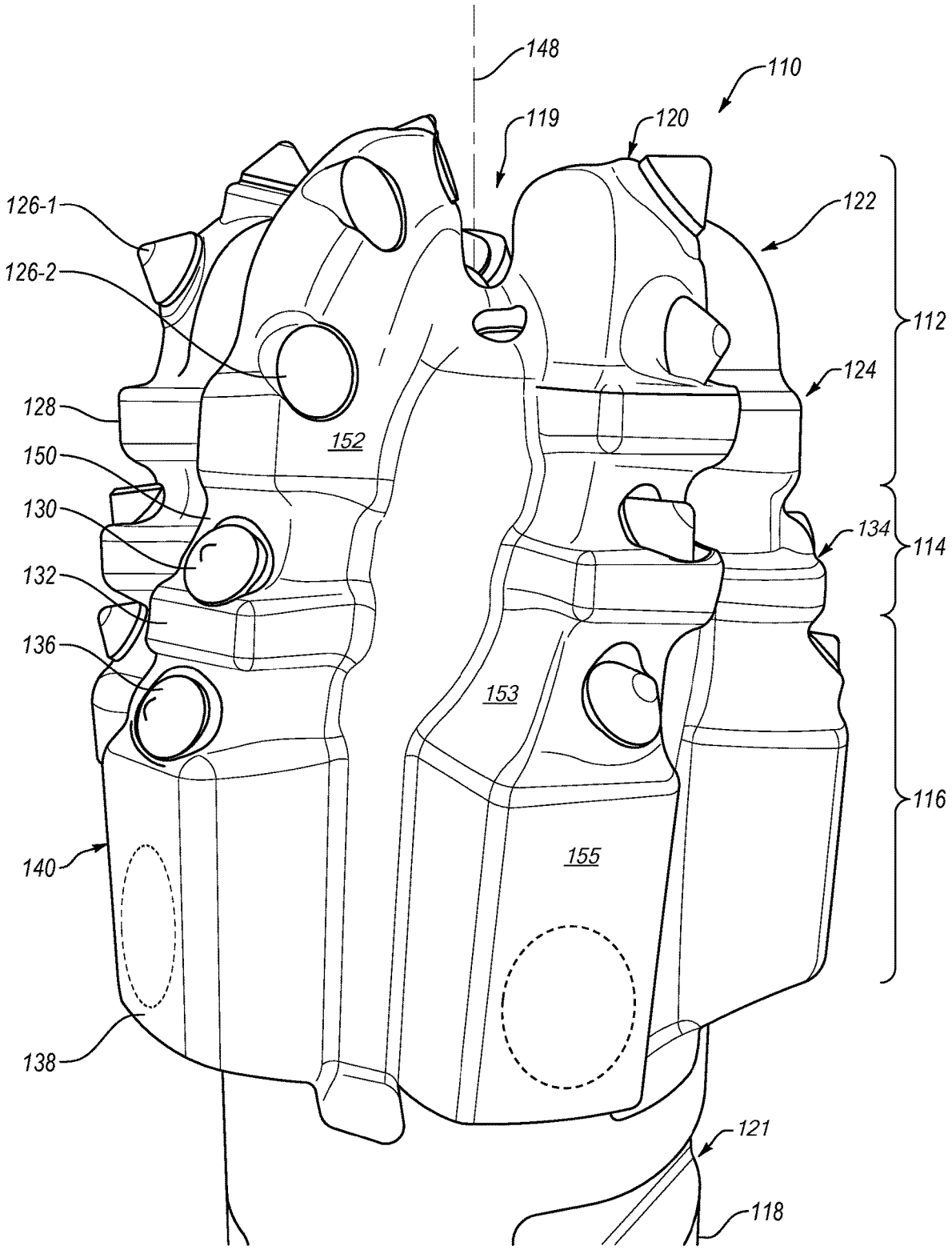
FIG. 2 is a side view of a downhole tool, according to at least one embodiment of the present disclosure.

In some embodiments, the bit 10 penetrates into the earth formation 11 and forms a wellbore 12 having a size that is generally equal to or greater than the gage diameter of the bit 10. In some embodiments, the bit 10 expands the diameter of the wellbore 12 in stages as the bit 10 advances through the formation 11. FIG. 2 illustrates an embodiment of a bit 110 that may be used in the drilling system 5 of FIG. 1, or in other drilling systems, according to some embodiments of the present disclosure.

In some embodiments, the bit 110 has a pilot section 112 at a terminal end of the bit 110 (i.e., an end of the bit 110 that is most distant from the surface of the wellbore). The bit 110 includes a first expansion section 114 and a second expansion section 116 sequentially in an uphole direction between the pilot section 112 and a connector 118. The connector 118 may be a pin or a box connection that allows the bit 110 to join to a BHA or drill string such as the BHA 16 or the drill string 15 described in relation to FIG. 1. In other embodiments, the connector 118 may be omitted and the bit 110 may be part of a steerable system. For instance, a bent motor sub or rotary steerable tool may include the bit 110 as an integral component thereof. In some embodiments, the bit 110 may include steering capabilities. For instance, the dashed circles in FIG. 2 schematically illustrate example steering pads that may selectively expand or retract to push the bit 110 in a manner similar to a rotary steerable tool. While the pads may be on the gage of the bit 110, in other embodiments the pads may be on a shank or connector (e.g., connector 118), or may be omitted entirely.

In some embodiments, a bit 110 has more than two expansion sections positioned between the pilot section 112 and the connector 118. For example, a bit 110 may have three, four, five, six, seven, or more expansion sections, with each successive section configured to expand the wellbore. In some embodiments, the expansion sections (e.g., sections 114, 116) may be stepped to provide stepped increases to the diameter of the bit. Accordingly, the bit 110 may be referred to herein as a stepped bit. Such terminology is not intended to indicate that expansion of each section must occur in a stepwise fashion. For instance, an expansion section may expand gradually or be continuously tapered, or there may be expansion sections that act as steps, while other expansion sections of a bit may be continuously tapered. In some embodiments, one or more breaker slots 121 or other feature to facilitate make-up or break-out of the bit 110 are included on the bit 110. For instance, in FIG. 2, optional breaker slots 121 are positioned between the second expansion section 116 and the connection 118.

In some embodiments, the pilot section 112, first expansion section 114, second expansion section 116, or combinations thereof are integrally formed with one another. For example, the pilot section 112, first expansion section 114, and second expansion section 116 may be monolithic and formed through casting of the pilot section 112, first expansion section 114, and second expansion section 116 together. In other examples, the pilot section 112, first expansion section 114, and second expansion section 116 may be machined from a single, monolithic piece of material, such as metal or ceramic powder in a green state. In yet other examples, the pilot section 112, first expansion section 114, and second expansion section 116 (or portions thereof) may be additively manufactured and sintered together to form a monolithic body.

In other embodiments, at least one of the pilot section 112, first expansion section 114, or second expansion section 116 may be coupled to another section by a friction fit, a snap fit, a compression fit, a mechanical interlock (such as threaded connectors, dovetail connectors, twist locks, posts, etc.), a mechanical fastener (e.g., a pin, rod, clip, clamp, bolt, screw, rivet, etc.), adhesive, weld, braze, or combinations thereof. In some embodiments, a portion of the pilot section 112 (e.g., a cutting element, a blade segment, etc.) may be formed separately and coupled to a pre-formed portion of the pilot section 112. Similarly, portions of the first and second expansion sections 114, 116 may be formed separately and coupled to pre-formed portions of the first and second expansion sections 114, 116.

In some embodiments, the pilot section 112 has a generally conventional drill bit geometry. For example, the pilot section 112 may include one or more cutting elements on fixed blades or roller-cone structures. In fixed-cutter or drag bit embodiments, the pilot section 112 may include a cone 119, a nose 120, a shoulder 122, and a pilot gage 124. The nose 120 may be a leading portion of the pilot section 112 (and of the stepped bit 110) that initially penetrates the earth formation, while the shoulder 122 more aggressively removes material from the earth formation. The pilot gage 124 may smooth and set a radius of the wellbore cut by the pilot section 112. The cone 119 may include a recess or depression at the terminal end of the bit 110 (and may generally be centered along an axis of the bit 110 and between some or potentially each of the blades of the bit 110). The cone 119 may include cutting elements on portions of the blades, or on the body of the bit 110. In some embodiments, the bit 110 includes blades (e.g. primary blades) that extend fully to, past, or near the axis of the bit 110, so that the cone may have a reduced or potentially no depression at the terminal end of the bit 110.

In some embodiments, the pilot section 112 includes a plurality of cutting elements 126-1, 126-2 (e.g., on a portion of blades of the bit 110 that corresponds to the pilot section 112). In some embodiments, the pilot section 112 includes at least one non-planar cutting element 126-1 and/or at least one planar cutting element 126-2. As used herein, a non-planar cutting element 126-1 are cutting elements with a cutting face or surface that is non-planar. For example, a non-planar cutting element 126-1 may have a conical cutting face, a ridged cutting face, a convex cutting face (such as a "bullet" cutting element), a concave cutting face (such as a cutting element with a chip-breaker feature), a wavy or scoop-shaped cutting face, or any other cutting element having at least one apex, ridge, or nadir in the cutting surface. As used herein, a planar cutting element 126-2 is a cutting element having a planar cutting face. In at least some embodiments, the planar cutting face is oriented generally normal to a sidewall of the cutting element (such as a shear cutter). The cutting elements 126-1, 126-2 may be coupled to or mounted on blades or other portions of the bit 110 in any suitable manner. For instance, the cutting elements 126-1, 126-2 may be brazed, press fit, mechanically interlocked, or integrally formed with blades of the bit 110. In some embodiments, a cutting element 126-1, 126-2 is a rolling cutting element. For instance, a sleeve may be mounted (e.g., brazed) to the bit 110, and the cutting element may be mechanically mounted within the sleeve to allow the cutting element to rotate about its central axis; however, in other embodiments, a rolling cutting element may be mounted directly in the bit body without a sleeve.

In some embodiments, the pilot section 112 has one or more planar cutting elements 126-2, one or more non-planar cutting elements 126-1, or combinations of the foregoing. For instance, one or more planar cutting elements 126-2 are optionally positioned on the cone 119, the nose 120, the shoulder 122, or combinations thereof, while one or more non-planar cutting elements 126-1 are optionally located on the pilot gage 124. In other embodiments, the pilot section 112 has one or more non-planar cutting elements 126-1 on the cone 119, the nose 120, the shoulder 122, or combinations thereof, while one or more planar cutting elements 126-2 are located on the pilot gage 124. In yet other embodiments, the pilot section 112 has one or more non-planar cutting elements 126-1 and one or more planar cutting elements 126-2 distributed in a mixture of locations, including in one or more of the same regions of the bit profile. For example, any or even each of the cone 119, nose 120, shoulder 122, and pilot gage 124 may have at least one non-planar cutting element 126-1 and at least one planar cutting element 126-2. Where the stepped bit 110 includes multiple non-planar cutting elements 126-1, each cutting element may be of the same type or shape, or combinations of different sizes, shapes, or types of non-planar cutting elements may be used. Different types (e.g. different shape, size, etc.) of non-planar cutting elements 126-1 may be used in the same or different regions of the stepped bit 110.

The pilot section 112 may create a pilot hole of the wellbore and each successive expansion sections 114, 116 of the stepped bit 110 may expand the radius of the wellbore to have the full gauge of the stepped bit 110. As the pilot section 112 creates a pilot hole of the wellbore, one or more pilot stabilizer pads 128 on the pilot gage 124 of the pilot section 112 of the blades may stabilize the stepped bit 110. In some embodiments, the one or more stabilizer pads 128 may be longitudinally uphole of some or each of the cutting elements 126-1, 126-2 of the pilot section 112.

In some embodiments, the first expansion section 114 on the blades of the bit 110 is longitudinally uphole of the pilot section 112 (and axially nearer the connection 118) and has a plurality of first expansion cutting elements 130. The first expansion cutting elements 130 may include planar or non-planar cutting elements at any suitable orientation or position. In FIG. 2, for instance, the first expansion cutting elements 130 include non-planar cutting elements oriented at a cutting element angle (see FIG. 4) relative to a longitudinal axis 148 of the stepped bit 110. The first expansion cutting elements 130 may shear, point load, gouge, break, loosen, or otherwise remove material to expand the wellbore from a pilot radius to a first expansion radius as weight is applied and the stepped bit 110 rotates about the longitudinal axis 148. In some embodiments, the first expansion section 114 has a plurality of first expansion stabilizer pads 132 positioned uphole (and potentially immediately uphole) of one or more of the first expansion cutting elements 130. The first expansion stabilizer pads 132 may stabilize the stepped bit 110 after expanding the wellbore with the first expansion cutting elements 130. In some embodiments, the one or more first stabilizer pads 132 may be longitudinally uphole of, and axially nearer the connection 118 as compared to, some or each of the first expansion cutting elements.

In some embodiments, the second expansion section 116 on blades of the bit 110 has a plurality of second expansion cutting elements 136. The second expansion cutting elements 136 may include planar or non-planar cutting elements at any suitable orientation or position. For instance, the second expansion cutting elements 136 may be oriented at a cutting element angle (see FIG. 4) to a longitudinal axis 148 of the stepped bit 110. The second expansion cutting elements 136 may break, loosen, or otherwise remove material to expand the wellbore from the first expansion radius to a second expansion radius. In some embodiments, the second expansion section 116 has a plurality of second expansion stabilizer pads 138 on a second expansion gage 140, and positioned uphole (and potentially immediately uphole) of one or more of the second expansion cutting elements 136. The second expansion stabilizer pads 138 may stabilize the stepped bit 110 after expanding the wellbore with the second expansion cutting elements 136. In some embodiments, the one or more second stabilizer pads 138 may be longitudinally uphole of, and axially nearer the connection 118 as compared to, some or each of the second expansion cutting elements.

In some embodiments, the stabilizer pads 128, 132, 138 may be configured to maintain gage while contacting a formation of other workpiece. For instance, the stabilizer pads 128, 132, 138 may include or be made of a wear-resistant surface. In some embodiments, a stabilizer pad 128, 132, 138 may be formed of a metal matrix material including a metal carbide material, or has hardfacing applied thereto. In the same or other embodiments, gage protection elements made of metal carbide, diamond, or other superhard materials may be used to maintain the gage diameter/radius of the stabilizer pads 128, 132, 138.

In some embodiments, at least one of the cutting elements 126-1, 126-2 on the pilot section may be oriented at a positive back rake angle (see FIG. 13-1), with the cutting end angled toward a leading face of a corresponding blade, and thus toward the rotational direction of the stepped bit 110. For example, at least one of the cutting elements 126 on the pilot section 112 may be oriented at a positive back rake angle. In another example, at least one of the cutting elements 126 on the first expansion section 114 may be oriented at a positive back rake angle. In yet another example, at least one of the cutting elements 126 on the second expansion section 116 may be oriented at a positive back rake angle.

In some embodiments, at least one of the first expansion cutting elements 130 has a back rake angle that is between 0° and 60°. For instance, such a back rake angle may have a lower value, an upper value, or lower and upper values including any of 0°, 2.5°, 5°, 7.5°, 10°, 12.5°, 15°, 17.5°, 20°, 25°, 30°, 35°, 40°, 45°, 60°, or any values therebetween. In some examples, at least one of the first expansion cutting elements 130 has a back rake angle greater than 1°. In the same or other examples, at least one of the first expansion cutting elements 130 has a back rake angle less than 45°. In still further of the same or other examples, at least one of the first expansion cutting elements 130 has a back rake angle between 1° and 45°, between 2° and 35°, between 5° and 30°, or between 7.5° and 20°. In still other embodiments, the back rake angle of one or more of the first expansion cutting elements 130 may be negative.

In some embodiments, at least one of the second expansion cutting elements 136 has a back rake angle that is between 0° and 60°. For instance, such a back rake angle may have a lower value, an upper value, or lower and upper values including any of 0°, 2.5°, 5°, 7.5°, 10°, 12.5°, 15°, 17.5°, 20°, 25°, 30°, 35°, 40°, 45°, 60°, or any values therebetween. In some examples, at least one of the second expansion cutting elements 136 has a back rake angle greater than 1°. In the same or other examples, at least one of the second expansion cutting elements 136 has a back rake angle less than 45°. In still further of the same or other examples, at least one of the second expansion cutting elements 136 has a back rake angle between 1° and 45°, between 2° and 35°, between 5° and 30°, or between 7.5° and 20°. In still other embodiments, the back rake angle of one or more of the second expansion cutting elements 136 may be negative.

Blades of the bit 110 may include a leading surface 152 facing the direction of rotation of the bit 110, and an opposing trailing surface 153. A formation-facing or top surface 155 may extend between the leading and trailing surfaces 152, 153. The top surface 155 may provide the contact area for stabilizer pads. In some embodiments, the top surface 155 may also provide an expansion shoulder on which cutting elements may be mounted. For instance, non-planar cutting elements 126-1 of FIG. 2 are shown as being mounted in pockets on top surfaces 155 of the blades of the stepped bit 110. In the same or other embodiments, however, cutting elements may be located in other areas of a blade or bit. For instance, as also shown in FIG. 2, planar cutting elements 126-2 may be positioned in a pocket formed at least partially in the leading surface 152 of some blades of the stepped bit 110. In other embodiments, planar cutting elements 126-2 may be mounted on or in a top surface 155, or a non-planar cutting element 126-1 may be mounted at least partially in a leading surface 152.

Figure 3:
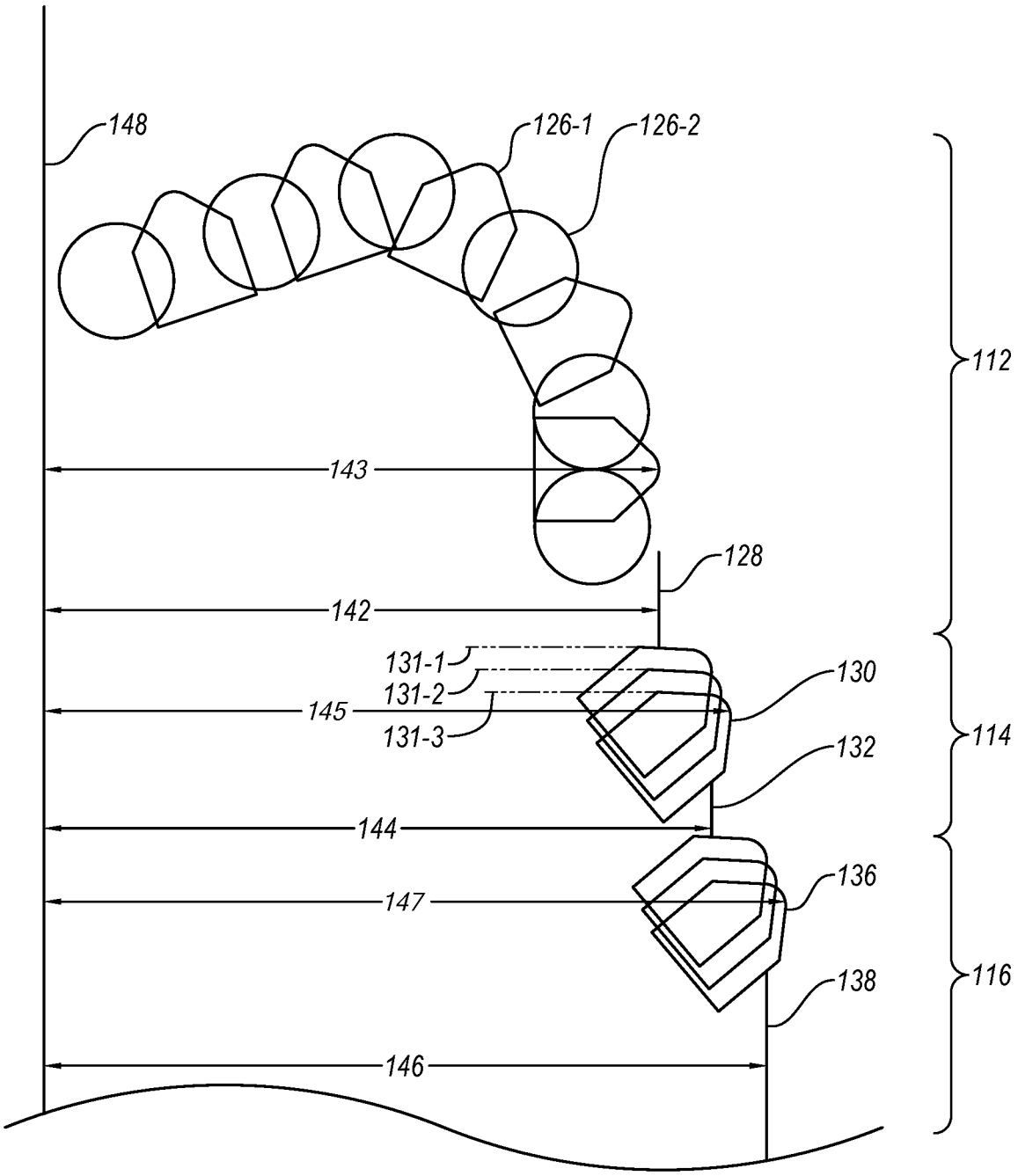
FIG. 3 is a composite cutting profile of the downhole tool of FIG. 2, according to at least one embodiment of the present disclosure.

In some embodiments, at least a portion of the pilot section 112, first expansion section 114, or second expansion section 116 of a blade (or combinations of the foregoing) may be tapered and/or undercut toward to the longitudinal axis 148 to provide clearance for removal of material (i.e., flushing cut material away), to enhance steerability or stability of the stepped bit 110, or for other purposes. For example, while the pilot gage 124 and/or pilot stabilizer pad 128, first expansion gage 134 and/or first expansion stabilizer pads 132, or second expansion gage 140 and/or second expansion stabilizer pads 138 of the top surface 155 of a blade of the bit 110 may be about parallel to the longitudinal axis 148 as shown in FIG. 3, in other embodiments the gage 130, 134, 140 and/or the stabilizer pads 128, 132, 138 (or portions thereof) may be oriented at a stabilizer pad taper angle relative to the longitudinal axis 148 (see stabilizer pads 428, 432, 438 and taper angle 433 as discussed with respect to FIG. 7). For instance, one or more of the stabilizer pads 128, 132, 138 may taper radially inwardly such that the radius decreases in a longitudinal uphole direction (i.e., a longitudinal direction away from the pilot section 112). In other embodiments, a stabilizer pad taper angle may be negative, such that the stabilizer pad 128, 132, 138 may taper radially outwardly such that the radius increases in a longitudinal uphole direction. Further, one stabilizer pad 128, 132, 138 may have one positive or negative taper angle, while another stabilizer pad 128, 132, 138 may have a different positive or negative taper angle.

In some embodiments, blades or other bit structures include expansion sections in which some or even each expansion section has an expansion surface (e.g., an expansion shoulder) on or to which cutting elements may be positioned/mounted. For example, at least some of the first expansion cutting elements 130 may be positioned on and/or in a first expansion surface such as the first expansion shoulder 150 (e.g., in or on a top surface 155 of the first expansion shoulder in a blade of the bit 110). In some embodiments, the first expansion shoulder 150 may extend axially in a direction that is perpendicular to the longitudinal axis 148. In other embodiments, the first expansion shoulder 150 may extend axially and/or radially at an angle that is non-perpendicular angle relative to the longitudinal axis 148. At least a portion of the first expansion shoulder 150 may be oriented at an angle to the longitudinal axis 148, such that the radial position is less at the portion of the first expansion shoulder 150 nearer the pilot section 112 than at the portion of the first expansion shoulder 150 nearer the second expansion portion 116 or connector 118. In such embodiment, the first expansion shoulder 150 may be considered as being tapered inwardly in a downhole direction. The angle of the first expansion shoulder may be in a range having a lower value, an upper value, or lower and upper values including any of 0°, 5°, 10°, 20°, 30°, 40°, 45°, 50°, 60°, 75°, 80°, 85°, 90°, or any values therebetween. In some examples, at least a portion of the first expansion shoulder 150 may be oriented at greater than a 30° angle relative to the longitudinal axis 148°. In other examples, at least a portion of the first expansion shoulder 150 may be oriented at ales than a 90° angle relative to the longitudinal axis 148. In yet other examples, at least a portion of the first expansion shoulder 150 may be oriented between a 30° and 90° angle relative to the longitudinal axis 148. In further examples, at least a portion of the first expansion shoulder 150 may be oriented at between a 40° and 80° an angle relative to the longitudinal axis 148.

FIG. 3 is a composite cutting and stabilizing profile of the stepped bit 110 of FIG. 2, illustrating the profile created by the cutting elements 126-1, 126-2 and stabilizer pads 128, 132, 138. The pilot section 112 may have a pilot radius 142, the first expansion section 114 may have a first expansion radius 144, and the second expansion section 116 may have a second expansion radius 146. The pilot radius 142 may be a distance between the longitudinal axis 148 and the radially most distant portion of the pilot stabilizing pad 128 of the pilot section 112. The first expansion radius 144 may be a distance between the longitudinal axis 148 and the radially most distant portion of the first expansion stabilizing pad 132, and the second expansion radius 146 may be the distance between the longitudinal axis 148 and the radially most distant portion of the second expansion stabilizing pad 138.

The pilot section 112 may further have a pilot cutting radius 143, the first expansion section 114 may have a first expansion cutting radius 145, and the second expansion section 116 may have a second expansion cutting radius 147. The pilot cutting radius 143 may be a distance between the longitudinal axis 148 and the radially most distant cutting tip or apex of a cutting element of the pilot section 112. The first expansion cutting radius 145 may be a distance between the longitudinal axis 148 and the radially most distant cutting tip or apex of a cutting element of the first expansion section 114, and the second expansion cutting radius 147 may be the distance between the longitudinal axis 148 and the radially most distant cutting tip or apex of a cutting element of the second expansion section 116. In FIG. 3, the pilot cutting radius 143 may be defined by the non-planar cutting element 126-1 nearest the pilot stabilizer pad 128 or first expansion section 114. The first expansion cutting radius 145 may be defined by the non-planar cutting element 126-1 nearest the first expansion stabilizer pad 132 or the second expansion section 116 (i.e., the cutting element at longitudinal position 131-3). The second expansion cutting radius 147 may be defined by the non-planar cutting element 126-1 nearest the second expansion stabilizer pad 138 or furthest from the pilot section 112 or first expansion section 114. In other embodiments, the radially most distant cutting tip or cutting apex may be on a planar cutting element or may be at a longitudinal position that is not nearest the corresponding stabilizer pad or subsequent expansion section.

In some embodiments, the pilot radius 142 may be in a range having a lower value, an upper value, or lower and upper values including any of 1.0 in. (2.54 cm), 2.0 in. (5.08 cm), 3.0 in. (7.62 cm), 4.0 in. (10.2 cm), 5.0 in. (12.7 cm), 6.0 in. (15.2 cm), 7.0 in. (17.8 cm), 8.0 in. (20.8 cm), 9.0 in. (22.9 cm), 10.0 in. (25.4 cm), 12 in. (30.5 cm), 15 in. (38.1 cm), 20 in. (50.8 cm), or any values therebetween. For example, the pilot radius 142 may be greater than 1.0 in. (2.54 cm). In the same or other examples, the pilot radius 142 may be less than 20 in. (50.8 cm). In yet other examples, the pilot radius 142 may be between 1.0 in. (2.54 cm) and 15 in. (38.1 cm). In further examples, the pilot radius 142 may be between 2.0 in. (5.08 cm) and 12 in. (33.5 cm). In yet further examples, the pilot radius 142 may be between 3.0 in. (7.62 cm) and 10.0 in. (25.4 cm). In at least one example, the pilot radius 142 may be between 3.5 in. (8.89 cm) and 6.0 in (15.2 cm).

In some embodiments, the first expansion radius 144 may be greater than the pilot radius 142. For example, the first expansion radius 144 may be greater than the pilot radius 142 by a percentage or proportion of the pilot radius 142. In other examples, the first expansion radius 144 may be greater than the pilot radius 142 by a nominal value.

In some embodiments, the first expansion radius 144 may be greater than the pilot radius 142 by a percentage of the pilot radius 142 in a range having a lower value, an upper value, or lower and upper values including any of 2%, 4%, 6%, 8%, 10%, 15%, 20%, 25%, 30%, 40%, 50%, 60%, 70%, 80%, 90%, 100%, or any values therebetween. For example, the first expansion radius 144 may be greater than 2% larger than the pilot radius 142. In other examples, the first expansion radius 144 may be less than 100% larger than the pilot radius 142. In yet other examples, the first expansion radius 144 may be between 2% and 100% larger than the pilot radius 142. In further examples, the first expansion radius 144 may be between 3% and 80% larger than the pilot radius 142. In at least one example, the first expansion radius 144 may be between 3% and 50%, between 5% and 25%, or between 5% and 10% larger than the pilot radius 142.

In some embodiments, the second expansion radius 146 may be greater than the first expansion radius 144 by a percentage of the first expansion radius 144 in a range having a lower value, an upper value, or lower and upper values including any of 2%, 4%, 6%, 8%, 10%, 15%, 20%, 25%, 30%, 40%, 50%, 60%, 70%, 80%, 90%, 100%, or any values therebetween. For example, the second expansion radius 146 may be greater than 2% larger than the first expansion radius 144. In other examples, the second expansion radius 146 may be less than 100% larger than the first expansion radius 144. In yet other examples, the second expansion radius 146 may be between 2% and 100% larger than the first expansion radius 144. In further examples, the second expansion radius 146 may be between 3% and 80% larger than the first expansion radius 144. In at least one example, the second expansion radius 146 may be between 3% and 50%, between 5% and 25%, or between 5% and 10% larger than the first expansion radius 144.

In the same or other embodiments, the second expansion radius 146 may therefore be greater than the pilot radius 142. For instance, in some embodiments, the pilot radius 142 may be between 50% and 95% of the second expansion radius 146. In more particular embodiments, the pilot radius 142 may be a percentage of the second expansion radius 146 that is within a range having lower values, upper values, or lower and upper values including any of 50%, 60%, 70%, 75%, 80%, 85%, 90%, 95%, and values therebetween. By way of illustration, the pilot radius 142 may be between 60% and 95%, between 70% and 92.5%, between 70% and 95%, between 80% and 90%, or between 85% and 90% of the second expansion radius 146. In other embodiments, the pilot radius 142 may be less than 50% or greater than 95% of the second expansion radius 146. In some embodiments, in addition to, or rather than, determining a percentage or ratio of the pilot radius 142 to the second expansion radius 146, the determination may be made by using the pilot cutting radius 143 and the second expansion cutting radius 147, which percentage or ratio may be within the same ranges described.

In some embodiments, the pilot cutting radius 143 may be equal to the pilot radius 142 at the stabilizer pad 128. In other embodiments, however, the pilot cutting radius 143 may be greater than or less than the pilot radius 142. For instance, in some embodiments, the pilot radius 142 may be undercut to be less than the pilot cutting radius 143. For instance, the pilot radius 142 may be less than the pilot cutting radius 143 by an amount that is up to 0.050 in. (1.27 mm), up to 0.030 in. (0.76 mm), up to 0.020 in. (0.51 mm), up to 0.015 in. (0.38 mm), up to 0.010 in. (0.25 mm), up to 0.005 in. (0.13 mm), or up to 0.002 in. (0.05 mm). In other embodiments, the pilot radius 142 may be less than the pilot cutting radius 143 by an amount greater than 0.050 in. (1.27 mm) or less than 0.002 in. (0.05 mm). For instance, the pilot radius 142 may be greater than or equal to the pilot cutting radius 143.

In the same or other embodiments, the first expansion cutting radius 145 may be equal to or different than the first expansion radius 144, the second expansion cutting radius 147 may be equal to or different than the second expansion radius 146, or combinations of the foregoing. For instance, the first expansion radius 144 may be less than the first expansion cutting radius 145 by an amount that is up to 0.050 in. (1.27 mm), up to 0.030 in. (0.76 mm), up to 0.020 in. (0.51 mm), up to 0.015 in. (0.38 mm), up to 0.010 in. (0.25 mm), up to 0.005 in. (0.13 mm), or up to 0.002 in. (0.05 mm). Similarly, the second expansion radius 146 may be less than the second expansion cutting radius 147 by an amount that is up to 0.050 in. (1.27 mm), up to 0.030 in. (0.76 mm), up to 0.020 in. (0.51 mm), up to 0.015 in. (0.38 mm), up to 0.010 in. (0.25 mm), up to 0.005 in. (0.13 mm), or up to 0.002 in. (0.05 mm). In other embodiments, the first or second expansion radii 144, 146 may be less than the corresponding first or second expansion cutting radius 145, 147 by an amount greater than 0.050 in. (1.27 mm) or less than 0.002 in. (0.05 mm). For instance, the first expansion radius 144 may be greater than or equal to the first expansion cutting radius 145, or the second expansion radius 146 may be greater than or equal to the second expansion cutting radius 147.

In some embodiments, at least one of the first expansion cutting elements 130 may be positioned at a different longitudinal position than another first expansion cutting element 130. In other embodiments, at least one of the second expansion cutting elements 136 may be positioned at a different longitudinal position as another second expansion cutting element 136. For example, the first expansion cutting elements 130 may be positioned at first longitudinal position 131-1, a second longitudinal position 131-2, a third longitudinal position 131-3, or more longitudinal positions. A single first expansion cutting element 130 may be located at any or each of the longitudinal positions 131-1, 131-2, 131-3, or more than one first expansion cutting element 130 may be located at any or each of the longitudinal positions 131-1, 131-2, 131-3.

In some embodiments, at least one of the first expansion cutting elements 130 may be positioned at a different radial position than another first expansion cutting element 130. In other embodiments, at least one of the second expansion cutting elements 136 may be positioned at a different radial position as another second expansion cutting element 136. For example, the first expansion cutting elements 130 at first longitudinal position 131-1 may be longitudinally nearer the pilot section 112 and radially nearer the longitudinal axis 148 than first expansion cutting elements 130 at the second longitudinal position 131-2. The first expansion cutting elements 130 at the second longitudinal position 131-2 may also be longitudinally nearer the pilot section 112 and radially nearer the longitudinal axis 148 than first expansion cutting elements 130 at the third longitudinal position 131-2. In other embodiments, first expansion cutting elements 130 may be at a same longitudinal position and at a different radial position. The series of longitudinal and/or radial positions may allow for incremental expansion from the pilot section 112 to the first expansion section 114. In some embodiments, at least two of the first expansion cutting elements 130 may be positioned at the same longitudinal position. The same or different of the at least two first expansion cutting elements may be positioned at the same radial position. In other embodiments, each of the first expansion cutting elements 130 may be positioned at a different longitudinal position. In some embodiments, an axial distance between the first longitudinal position 131-1 and the second longitudinal position 131-2 may be less than 1 in. (2.54 cm), less than 0.75 in. (1.9 cm), less than 0.5 in. (1.27 cm), or less than 0.25 in. (0.64 cm). In the same or other embodiments, a radial distance between the apex of first expansion cutting elements 130 at adjacent radial positions may be less than 1 in. (2.54 cm), less than 0.75 in. (1.9 cm), less than 0.5 in. (1.27 cm), less than 0.25 in. (0.64 cm), or less than 0.125 in. (0.32 cm). Second expansion cutting elements 136 may be positioned at the same or different radial or longitudinal positions in a manner similar to that described herein for the first expansion cutting elements 130.

Figure 4:
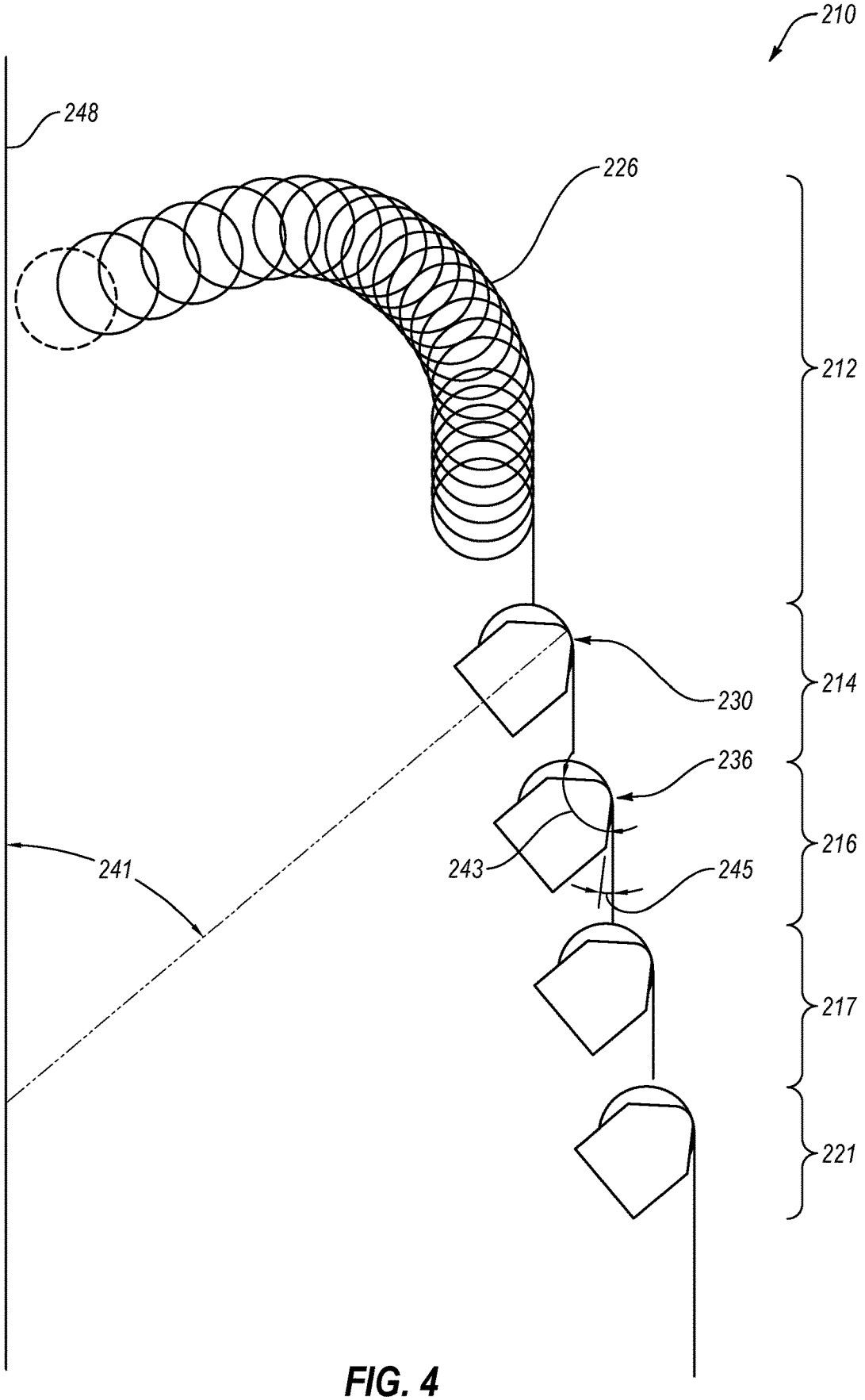
FIG. 4 is a composite cutting profile of a downhole tool, according to at least one additional embodiment of the present disclosure.

FIG. 4 illustrates a composite cutting profile of a stepped bit 210, according to other embodiments of the present disclosure. The stepped bit 210 may have at least a pilot section 212, a first expansion section 214, and a second expansion section 216. FIG. 4 illustrates an embodiment of a stepped bit 210 with additional expansion sections, including a third expansion section 217 and a fourth expansion section 221. In some embodiments, the pilot section 212 has a uniform type of cutting element 226, such as all planar cutting elements or all non-planar cutting elements. In other embodiments, at least one of the expansion sections 214, 216, 217, 221 has a mixture of cutting elements such as planar and non-planar first or second expansion cutting elements 230, 236.

In some embodiments, a longitudinal axis of at least one of the first expansion cutting elements 230 and/or at least one of the second expansion cutting elements 236 may be oriented at cutting element angle 241 relative to the longitudinal axis 248. For example, at least one of the first or second expansion cutting elements 230, 236 (or cutting elements of other expansion sections) may be oriented at a cutting element angle 241 relative to the longitudinal axis 248, with the cutting element angle 241 in a range having a lower value, an upper value, or lower and upper values including any of 0°, 1°, 2°, 4°, 6°, 8°, 10°, 12°, 14°, 16°, 18°, 20°, 25°, 30°, 35°, 40°, 45°, 50°, 55°, 60°, 65°, 75°, or any values therebetween. In some examples, a cutting element angle 241 of at least one of the first or second expansion cutting elements 230, 236 may be greater than 1°. In other examples, a cutting element angle 241 of at least one of the first or second expansion cutting elements 230, 236 may be less than 65°, between 1° and 65°, between 5° and 60°, between 10° and 55°, between 25° and 65°, between 40° and 60°, or between 45° and 55°.

In embodiments with non-planar cutting elements, a cutting element has a cutting surface included angle 243 (shown with respect to the second expansion cutting element 236 in FIG. 4). The second expansion cutting element 236 is shown as having a conical or ridged configuration with the cutting surface included angle 243 as the angle between opposing edges in a profile or cross-sectional view of the second expansion cutting element 236. In some embodiments, the cutting surface included angle 243 may be in a range having an upper value, a lower value, or an upper and lower value including any of 45°, 60°, 75°, 90°, 105°, 120°, 135°, 150°, 165°, or any values therebetween. For example, the cutting surface angle 243 may be greater than 60°. In other examples, the cutting surface angle 243 may be less than 165°. In yet other examples, the cutting surface angle 243 may be between 60° and 165°, between 75° and 150°, between 80° and 110°, between 60° and 100°, or between 90° and 120°.

The cutting surface included angle 243 is optionally related to the cutting element angle 241 for such a cutting element, and may be used to orient an outer radial side surface of a cutting end of the cutting element at an alignment angle 245 relative to the longitudinal direction. In some embodiments, the alignment angle 245 may be in a range having a lower value, an upper value, or lower and upper values including any of 0°, 0.2°, 0.5°, 1°, 1.5°, 2°, 3°, 4°, 5°, 7.5°, 10°, or any values therebetween. For example, the alignment angle 245 may be greater than 0.2°. In other examples, the alignment angle 245 may be less than 5°. In yet other examples, the alignment angle 245 may be between 0.2° and 10°, between 0.5° and 5°, or between 1° and 3°.

Figure 5:
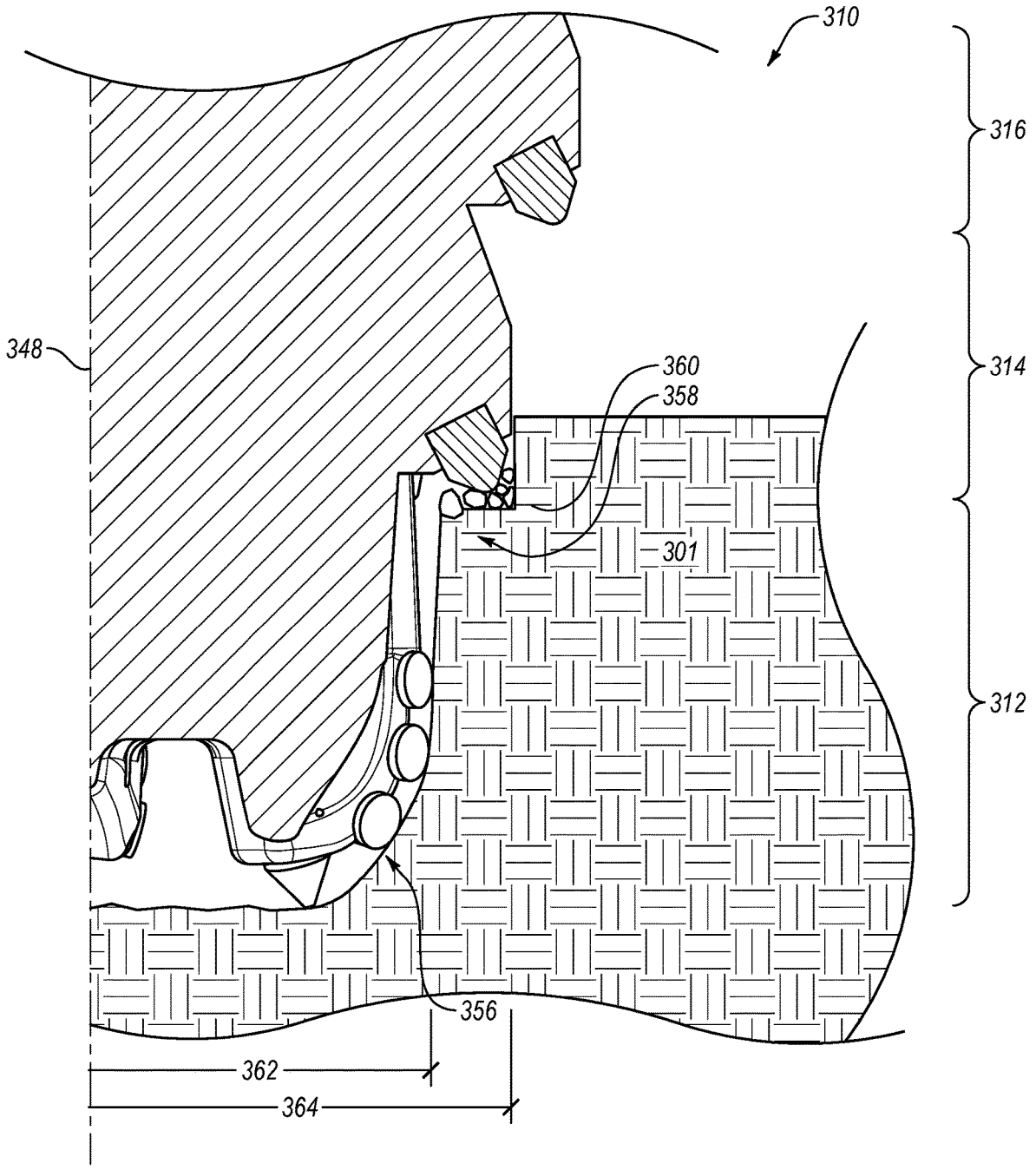
FIG. 5 is schematic representation of a downhole tool removing material from an unsupported region of a formation, according to at least one embodiment of the present disclosure.
Figure 6:
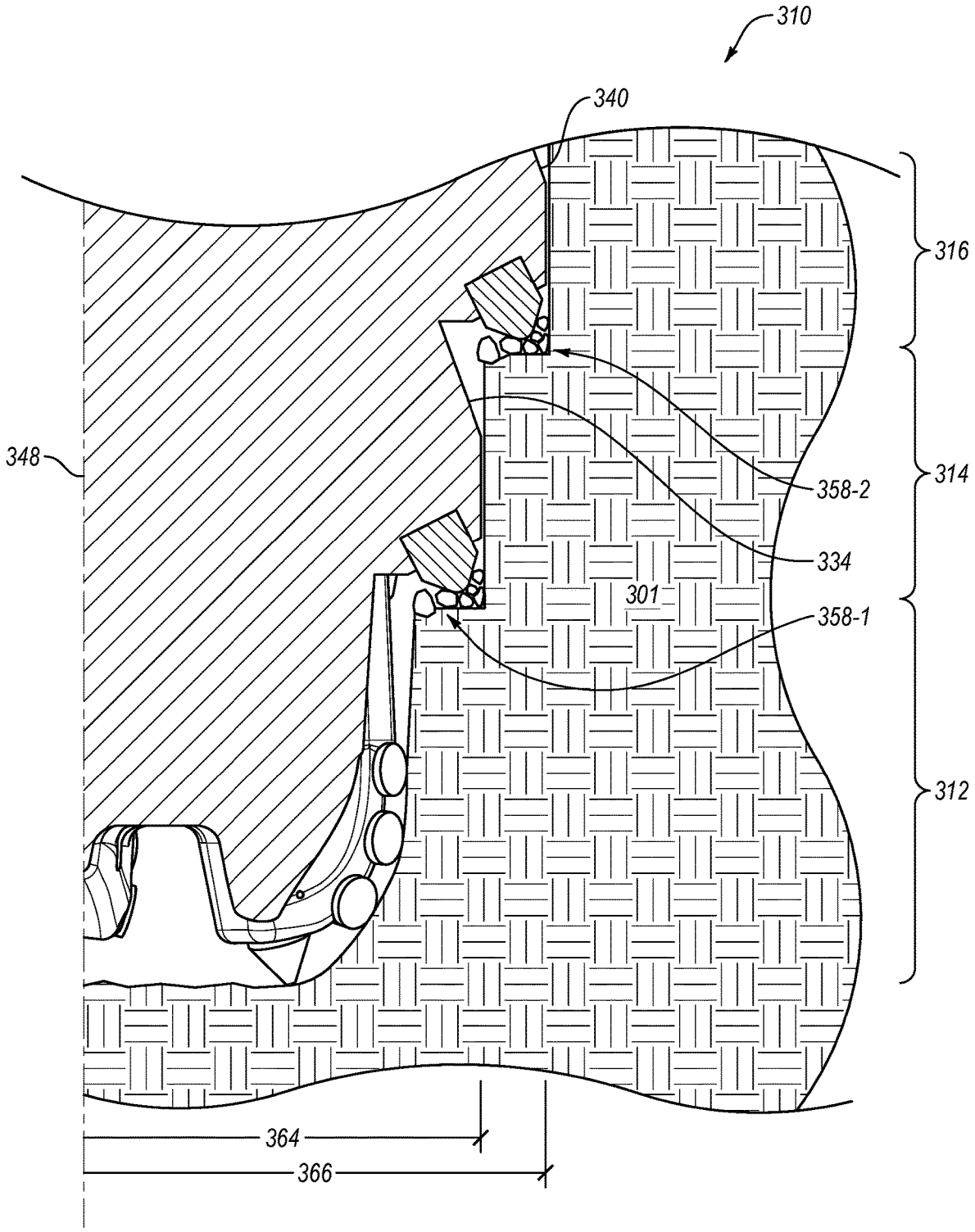
FIG. 6 is a schematic representation of the downhole tool of FIG. 5 advancing in the formation, according to at least one embodiment of the present disclosure.

After creating a pilot hole, expansion sections of a bit of the present disclosure may expand the pilot hole in successive stages by removing unsupported material adjacent the pilot hole or adjacent a preceding expansion section. FIGS. 5 and 6 are exaggerated drawings that illustrate the process of removing material using a stepped bit according to some embodiments the present disclosure. FIG. 5 is an exaggerated representation of an embodiment of a stepped bit 310 creating a wellbore in an earthen formation 301. The stepped bit 310 has a cutting profile 354 that is a composite of the cutting elements of the stepped bit 310 when rotated about the rotational axis 348 and combined into a single plane (see, e.g., FIGS. 3 and 4). The cutting profile defines a pilot hole 356 with a pilot radius 362. As the pilot section 312 drills and creates the pilot hole 356, the wall of the pilot hole 356 creates an unsupported region 358 of formation 301. The unsupported region 358 is unconstrained on the inner surface (proximate the pilot section 312). A shear force parallel to the unconstrained face may cause the unsupported region 358 to fail and break into pieces 360 with less force and/or energy than a supported portion of the formation 301. For example, the first expansion section 314 may contact the formation 301 and impart a force and/or energy to the unsupported region 358 to fail the unsupported region toward the longitudinal axis 348 of the stepped bit 310, which expands the pilot hole 356 from the pilot hole radius 362 to a first expansion radius 364.

FIG. 6 illustrates the expansion of the first expansion radius 364 to a second expansion radius 366. In some embodiments, the first expansion second section 314 may fail a first unsupported region 358-1 created by the pilot section 312 toward the longitudinal axis 348 of the stepped bit 310, thereby expanding the wellbore and exposing a second unsupported region 358-2. The second expansion section 316 may fail the second unsupported region 358-2 toward the longitudinal axis 348 to expand the wellbore and potentially expose an additional unsupported region. In some embodiments, a full or partial portion of a first expansion stabilizer/gage pad 334 and/or second expansion stabilizer/gage pad 340 may be undercut and/or tapered toward the longitudinal axis 348. In some embodiments, an undercut and/or tapered first expansion stabilizer/gage pad 334 and/or second expansion stabilizer/gage pad 340 may provide clearance for the unsupported region 358-1, 358-2 to fail toward the longitudinal axis 348. In other embodiments, an undercut and/or tapered first expansion stabilizer/gage pad 334 and/or second expansion stabilizer/gage pad 340 may provide clearance for formation 301 debris from the failed unsupported region 358-1, 358-2 to be flushed away by a drilling fluid.

Figure 7:
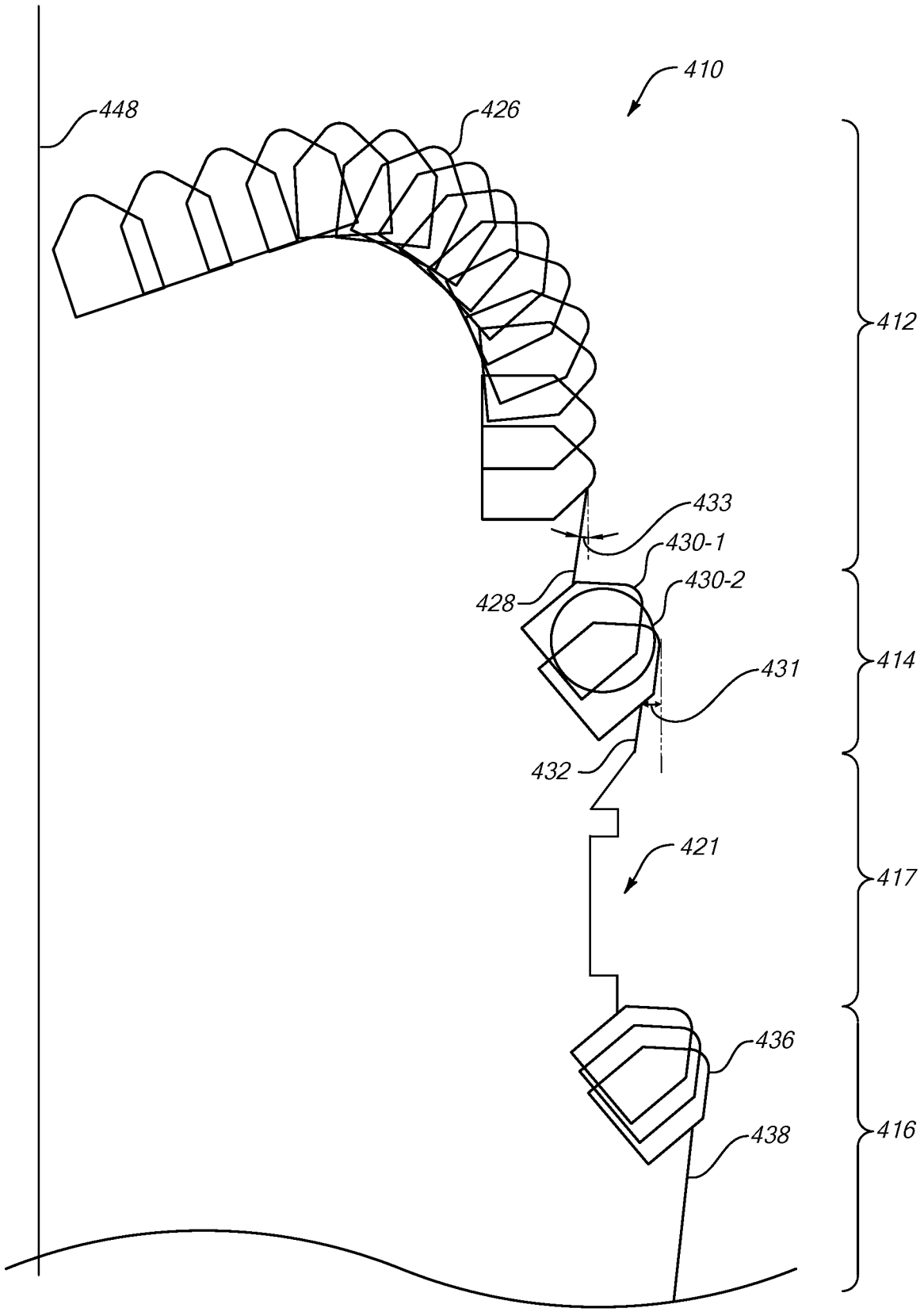
FIG. 7 is a composite cutting profile of a downhole tool with a breaker slot downhole of a breaker slot, according to at least one embodiment of the present disclosure.

FIG. 7 illustrates another embodiment of a bit 410 that may be used in the drilling system 5 of FIG. 1, or in other drilling systems, according to some embodiments of the present disclosure. The bit 410 may include pilot section 412 at a terminal end of the bit 410. The bit 410 may further include a first expansion section 414 and a second expansion section 416 sequentially in an uphole direction between the pilot section 112 and a connector (e.g., connector 118 of FIG. 1). In some embodiments, the bit 410 may also include a bit breaker section 417 that includes one or more breaker slots 421 or other features to facilitate break-out or make-up of the bit 410 with a drill collar, BHA, tool string, or other component. In the illustrated embodiment, the bit breaker section 417 is shown as being positioned longitudinally between the first expansion section 414 and the second expansion section 416. In other embodiments, however, the bit breaker section 417 may be positioned in other locations. For instance, the bit breaker section 417 may be positioned between the pilot section 412 and the first expansion section 414, or longitudinally between the second expansion section 416 and one or more other expansion sections uphole of the second expansion section 416 (e.g., between the second expansion section and a third expansion section, between third and fourth expansion sections, etc.). In some embodiments, the breaker section 417 may be within an expansion section. For instance, although FIG. 7 illustrates the first expansion section 414 as having first expansion cutting elements 430-1, 430-2 and a first expansion stabilizer pad 432 downhole of and nearer the pilot section 412 as compared to the bit breaker section, in other embodiments, the bit breaker section 417 may be on, within, or downhole of the first expansion stabilizer pad 432, or even longitudinally between different longitudinal positions of first expansion cutting elements 430-1, 430-2 within the first expansion section 414.

One or more additional expansion sections (not shown) may also be included uphole of the second expansion section 416. In some embodiments, one or more of the expansion sections 414, 416 or additional expansion sections include cutting elements, without any corresponding stabilizer pad. For instance, a third expansion section 416 may include cutting structure but no stabilizer pad, such that cutting elements are further uphole than any stabilizer pad.

Other than the position of the bit breaker section 417, the bit 410 may be similar to, or the same as, bits 10, 110, 210, and 310 or other bits as described or claimed herein. For instance, the bit 410 may include pilot cutting elements 426 at any or each of a cone, nose, shoulder, and gage portion of the pilot section 412. The pilot cutting elements 426 may include any combination of planar or non-planar cutting elements, although each of the pilot cutting elements 426 are shown as being non-planar.

The pilot section 412 may create a pilot hole of the wellbore using successive expansion sections 414, 416 of the bit 410 that expand the radius of the wellbore to have the full gauge of the bit 410. As the pilot section 412 creates a pilot hole of the wellbore, one or more pilot stabilizer pads 428 at or near the gage of the pilot section 412 of the cutting profile may stabilize the stepped bit 410. In some embodiments, the one or more stabilizer pads 428 may be longitudinally uphole of some or each of the cutting elements 426 of the pilot section 412.

The first expansion section 414 on the blades and cutting profile of the bit 410 may be longitudinally uphole of the pilot section 412 and may have a plurality of first expansion cutting elements 430-1, 430-2 (collectively first expansion cutting elements 430). The first expansion cutting elements 430 may include non-planar cutting elements 430-1 or planar cutting elements 430-2 at any suitable orientation or position (e.g., radial position, axial position, cutting element angle, etc.). The first expansion cutting elements 430 may shear, point load, gouge, break, loosen, or otherwise remove material to expand the wellbore from a pilot radius to a first expansion radius as weight is applied and the stepped bit 410 rotates about the longitudinal axis 448.

In some embodiments, the first expansion section 414 has a plurality of first expansion stabilizer pads 432 positioned uphole (and potentially immediately uphole) of one or more of the first expansion cutting elements 430. The first expansion stabilizer pads 432 may be on blades or floating stabilizer pads within the bit 410, and may stabilize the bit 410 in the portion of the wellbore expanded by the first expansion cutting elements 430.

In some embodiments, the second expansion section 416 on the blades and cutting profile of the bit 410 has a plurality of second expansion cutting elements 436. Similar to the first expansion cutting elements 430, the second expansion cutting elements 436 may include planar or non-planar cutting elements at any suitable orientation, position or position. The second expansion cutting elements 436 may break, loosen, or otherwise remove material to expand the wellbore from the first expansion radius to a second expansion radius.

In some embodiments, the second expansion section 416 has a plurality of second expansion stabilizer pads 438 positioned uphole (and potentially immediately uphole) of one or more of the second expansion cutting elements 436. The second expansion stabilizer pads 138 may be on blades or floating stabilizer pads within the bit 410 and may stabilize the bit 410 in the portion of the wellbore expanded by the second expansion cutting elements 436.

In some embodiments, the stabilizer pads 428, 432, 438 may be configured to maintain gage while contacting a formation of other workpiece. In some embodiments, at least a portion of a stabilizer pad 428, 432, 438 may be tapered or undercut toward to the longitudinal axis 448 to provide clearance for removal of material (i.e., flushing cut material away), to enhance steerability or stability of the bit 410, or for other purposes. For instance, in FIG. 7, a greatest radius of the first expansion stabilizer pad 432 is shown as being less than a greatest radius of the first expansion cutting elements 430. The difference in radial position is shown as an undercut distance 431. One or more of the pilot stabilizer pad 428 or second expansion stabilizer pad 438 may also, or instead, be undercut by the undercut distance 431. In some illustrative embodiments, the undercut distance 431 may be up to 0.050 in. (1.27 mm), up to 0.030 in. (0.76 mm), up to 0.020 in. (0.51 mm), up to 0.015 in. (0.38 mm), up to 0.010 in. (0.25 mm), up to 0.005 in. (0.13 mm), or up to 0.002 in. (0.05 mm). Where multiple stabilizer pads 428, 432, 438 are undercut by an undercut distance, the distance may be the same for one or more (and potentially each) stabilizer pad 428, 432, 438, or different undercut distances may be used for one or more (and potentially each) stabilizer pad 428, 432, 438.

Whether or not a stabilizer pad 428, 432, 438 is undercut, the stabilizer pads 428, 432, 438 may be about parallel to the longitudinal axis 448 (as shown by stabilizer pads 128, 132, 138 in FIG. 3). In other embodiments (and with or without an undercut), one or more of the stabilizer pads 428, 432, 438 may be oriented at an angle relative to the longitudinal axis 448. For instance, FIG. 7 illustrates the stabilizer pads 428, 432, 438 as each being oriented at an angle relative to the longitudinal axis 448. In particular, a stabilizer pad taper angle 433 is shown in FIG. 7 with reference to the pilot stabilizer pad 428, although a same or different taper angle may be used for any or each other stabilizer pad of the bit 410. In the illustrated embodiment, the cutting profile is shown and the taper angle can be measured in a direction initially extending away from the longitudinal axis 448 (to the right, in a counterclockwise direction in the orientation shown in FIG. 7), and to a line parallel to the longitudinal axis 448 of the bit 410. The line that is parallel to the bit may pass through a point of the stabilizer pad having the greatest radial position. In FIG. 7, the stabilizer pads 428, 432, 438 taper radially outwardly such that the radius decreases in a longitudinal uphole direction. In other embodiments, a stabilizer pad may taper radially outwardly such that the radius increases in the longitudinal uphole direction.

In some embodiments, the stabilizer pad taper angle 433 of a stabilizer pad 428, 432, 438 may be in a range having a lower value, an upper value, or lower and upper values including any of 0.2°, 0.5°, 1°, 1.5°, 2°, 3°, 4°, 5°, 10°, 15°, or any values therebetween. For example, the stabilizer pad taper angle 433 may be greater than 0.2°. In other examples, the stabilizer pad taper angle 433 may be less than 15°. In yet other examples, the stabilizer pad taper angle 433 may be between 0.2° and 5°. In further examples, the stabilizer pad taper angle 433 may be between 0.5° and 4°. In yet further examples, the stabilizer pad taper angle 433 may be between 1° and 3°. In other embodiments, the stabilizer pad taper angle 433 angle may be greater than 15°. The stabilizer pad taper angle 433 may be referred to as negative when the taper is outward so the radius increases in a longitudinal uphole direction. The magnitude of a negative stabilizer pad taper angle may fall within the ranges discussed herein for a positive stabilizer pad taper angle.

As should be appreciated in view of the disclosure herein, stabilizer pads may have a variety of different orientations and configurations, and may be varied based on a variety of different criteria (e.g., steerability, lateral vibration tolerances, axial vibration tolerances, torsional vibration tolerances, rate of penetration targets, torque tolerances, etc.). In some embodiments, stabilizer pad configurations of pilot and/or expansion sections of a bit may be varied in terms of number (e.g., number of expansion sections), orientation (e.g., taper angle), position (e.g., undercut), and the like. In the same or other embodiments, the size (e.g., width or length) of stabilizer pads may also be varied. For instance, any one or more of the stabilizer pads 428, 432, 438 (as well as the stabilizer pads of bits 110, 210, 310) may have a length that is between 0.1 in. (0.25 cm) and 10.0 in. (25.4 cm), in some embodiments, For instance, the length of a stabilizer pad 428, 432, 438 may be within a range having a lower limit, an upper limit, or lower and upper limits that include any of 0.1 in. (0.25 cm), 0.25 in. (0.64 cm), 0.4 in. (1.02 cm), 0.45 in. (1.14 cm), 0.5 in. (1.27 cm), 0.55 in. (1.40 cm), 0.6 in. (1.52 cm), 0.75 in. (1.91 cm), 1.0 in. (2.54 cm), 2.5 in. (6.35 cm), 5.0 in. (12.7 cm), 10 cm (25.4 cm), or values therebetween. For instance, a stabilizer pad 428, 432, 438 may have a length between 0.25 in. (0.64 cm) and 2.5 in. (6.35 cm), a length between 0.4 in. (1.02 cm) and 2.0 in. (5.08 cm), or a length between 0.45 in. (1.14 cm) and 1.0 in. (2.54 cm). In the same or other embodiments, a stabilizer pad 428, 432, 438 may be at least 0.4 in. (1.02 cm) or at least 0.5 in. (1.27 cm). In other embodiments, the stabilizer pad 428, 432, 438 may have a length less than 0.1 in. (0.25 cm) or greater than 10.0 in. (25.4 cm). Further, as cutting elements may be positioned at different axial and/or radial positions on different blades of a bit 410, in some embodiments, the stabilizer pad on one blade may be a different longitudinal length than the stabilizer on another blade, even when the stabilizer pads are in the same pilot section 412, first expansion section 416, second expansion section 416, third or fourth expansion section, etc.

The length of the stabilizer pads may also vary depending on the section. For instance, the second expansion stabilizer pad 438 is shown as being longer than the pilot stabilizer pad 428 and longer than the first expansion stabilizer pad 432. In some embodiments, a ratio of the length of the second expansion stabilizer pad 438 (or potentially the uppermost stabilizer pad) to the pilot or first expansion stabilizer pads 428, 432 may be within a range including a lower limit, upper limit, or lower and upper limits including any of 1:10, 1:5, 1:4, 1:3, 1:2, 1:1, 2:1, 3:1, 4:1, 5:1, or 10:1.

In some embodiments, the length of a stabilizer pad (or a combined length of stabilizer pads) in a cutting profile view such as that shown in FIGS. 3, 4, and 7 may be defined as a ratio of the length of the stabilizer pad(2) to a total length/height of the bit cutting structure (i.e., the combined length of the pilot section and all expansion sections). In some embodiments, the any single stabilizer pad may be between 2% and 15% of the height of the bit cutting structure. For instance, the percentage of the bit cutting structure height made up by a single stabilizer pad may be within a range including a lower limit, an upper limit, or lower and upper limits including any of 2%, 2.5%, 3%, 4%, 5%, 7.5%, 10%, 12.5%, 15%, or any values therebetween. In other embodiments, the percentage may be less than 2% or greater than 15%. In some embodiments, the combined height of stabilizer pads (e.g., the height of stabilizer pads 428, 432, 438 as measured parallel to the axis 448 in a cutting profile view) may be between 4% and 60% of the height of the bit cutting structure. For instance, the percentage of the bit cutting structure height made up by the combined stabilizer pads may be within a range including a lower limit, an upper limit, or lower and upper limits including any of 4%, 5%, 7.5%, 10%, 15%, 20%, 25%, 30%, 35%, 37.5%, 40%, 45%, 50%, 55%, 60%, or values therebetween. In other embodiments, the percentage may be less than 4% or greater than 60%.

Figure 9:
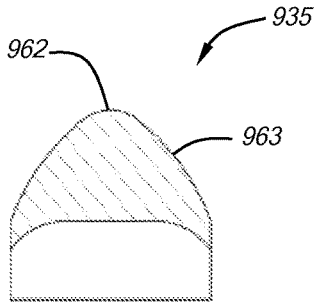

The term "cutting element" as used herein generically refers to any type of cutting element, unless otherwise specified. Cutting elements may have a variety of configurations, and in some embodiments may have a planar cutting face (e.g., similar to cutting elements 126-2 of FIG. 2). Other cutting elements may have a non-planar cutting surface or end, such as a generally pointed cutting end, a generally conical cutting end (e.g., cutting elements 126-1 of FIG. 2), a generally conical cutting end having a ridge (e.g., a crest or apex) extending across a full or partial diameter of the cutting element (e.g., cutting element 1135 of FIGS. 11-1 and 11-2), a bullet cutting end (e.g., cutting element 935 of FIG. 9), or other non-planar shapes, for example.

Figure 8:
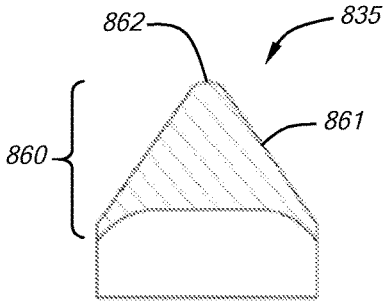
FIGS. 8-10 are partial cross-sectional views of non-planar cutting elements, according to at least one embodiment of the present disclosure.

As used herein, the term "conical cutting elements" refers to cutting elements having a generally conical cutting end. FIG. 8, for instance, illustrates a conical cutting element 835 having a generally conical cutting end 860 (including either right cones or oblique cones), i.e., a conical side wall 861 that terminates in a rounded apex 862. Unlike geometric cones that terminate at a sharp point apex, the conical cutting elements of some embodiments of the present disclosure possess an apex 862 having curvature between the conical side wall 861 and the apex 862. An angle between lateral ends of the sidewalls 861 may be considered a cutting surface included angle as discussed herein.

Figure 10:
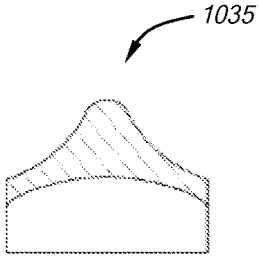

Further, in one or more embodiments, a bullet cutting element 935 may be used. The term "bullet cutting element" refers to a cutting element having, instead of a generally conical side surface, a generally convex side surface 963 terminating at a rounded or pointed apex 962, such as the illustrative cutting element 935 shown in FIG. 9. In one or more embodiments, the apex 962 is rounded and has a substantially smaller radius of curvature than the convex side surface 963. Both conical cutting elements and bullet cutting elements are "pointed cutting elements," having a pointed end that may be abrupt/sharp or rounded. It is also intended that the non-planar cutting elements of the present disclosure may also include other shapes, including, for example, a pointed cutting element may have a concave side surface terminating in a rounded or apex, as shown by the cutting element 1035 of FIG. 10.

Figures 1, 11:
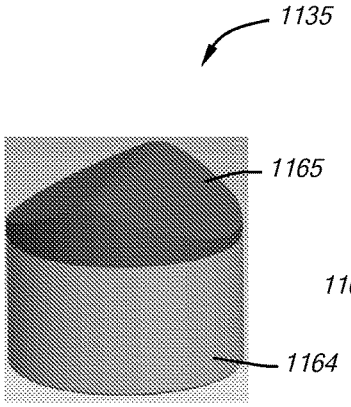
Figures 2, 11:
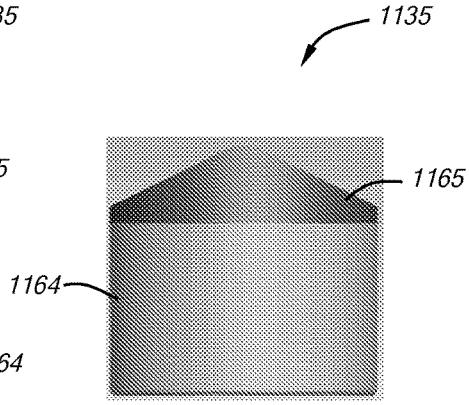
Figure 12:
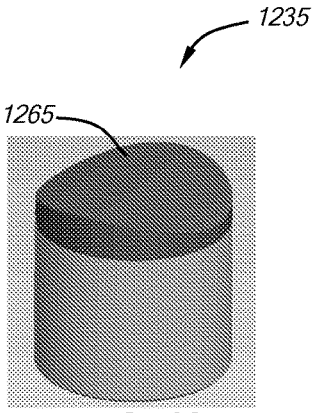
FIG. 12 is a perspective view of another ridge cutting element, according to at least one embodiment of the present disclosure.

The term "ridge cutting element" refers to a cutting element that has a cutting crest (e.g., a ridge or apex) extending a height above a substrate (e.g., cylindrical substrate 1164 of FIG. 11-1), and at least one recessed region extending laterally away from the crest. An embodiment of a ridge cutting element 1135 is depicted in FIGS. 11-1 and 11-2, where the cutting element top surface 1165 has a parabolic cylinder shape and is coupled to the substrate 1164. Variations of the ridge cutting element may also be used, and for example, while the recessed region(s) may be shown as being substantially planar, the recessed region(s) may instead be convex or concave. While the crest is shown as extending substantially linearly along its length, it may also be convex or concave and may include one or more peaks and/or valleys, including one or more recessed or convex regions (e.g., depressions in the ridge), or may have a crest extending along less than a full width of the cutting element. In some embodiments, the ridge cutting element may have a top surface that has a reduced height between two cutting edge portions, thereby forming a substantially saddle shape or hyperbolic paraboloid (e.g., top surface 1265 of the cutting element 1235 of FIG. 12).

Figures 1, 13:
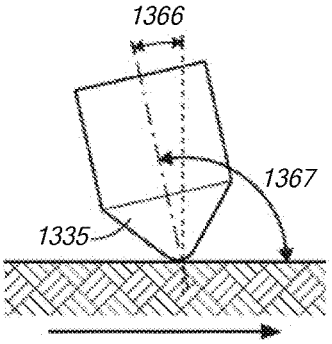
Figures 2, 13:
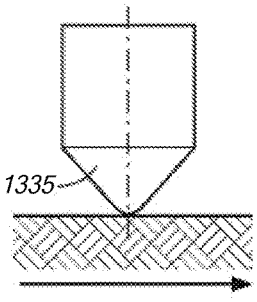
Figures 3, 13:
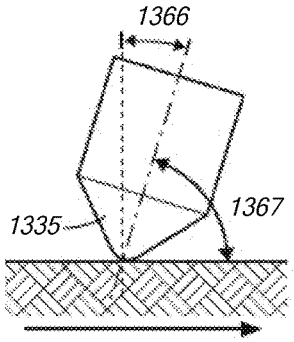

Orientations of planar cutting elements (or shear cutting elements) on a bit may be referenced using terms such as "side rake" and "back rake." While non-planar cutting elements may be described as having a back rake and side rake in a similar manner as planar cutting elements, non-planar cutting elements may not have a cutting face or may be oriented differently (e.g., out from a formation facing or top surface rather than toward a leading edge/surface), and thus the orientation of non-planar cutting elements should be defined differently. When considering the orientation of non-planar cutting elements, in addition to the vertical or lateral orientation of the cutting element body, the non-planar geometry of the cutting end also affects how and the angle at which the non-planar cutting element strikes the formation. Specifically, in addition to the back rake affecting the aggressiveness of the interaction of the non-planar cutting element with the formation, the cutting end geometry (specifically, the apex angle and radius of curvature) may affect the aggressiveness that a non-planar cutting element attacks the formation. In the context of a pointed cutting element, as shown in FIGS. 13-1 to 13-3 (collectively FIG. 13), back rake is defined as the angle 1366 formed between the axis of the pointed cutting element 1335 (specifically, the axis of the pointed cutting end) and a line that is normal to the formation or other material being cut. As shown in FIG. 13-2, with a pointed cutting element 1335 having zero back rake, the axis of the pointed cutting element 1335 is substantially perpendicular or normal to the formation material. As shown in FIG. 13-3, a pointed cutting element 1335 having negative back rake angle 1366 has an axis that engages the formation material at an angle 1367 that is less than 90° as measured from the formation material. Similarly, a pointed cutting element 1335 having a positive back rake angle 1366 as shown in FIG. 13-1 has an axis that engages the formation material at an angle 1367 that is greater than 90° when measured from the formation material. In some embodiments, the back rake angle 1366 of the pointed cutting elements may be zero, or in some embodiments may be negative. In some embodiments, the back rake angle of the pointed cutting elements 1335 may be between −20° and 20°, −10° and 10°, 0° and 10°, or −5° and 5°.

Figure 14:
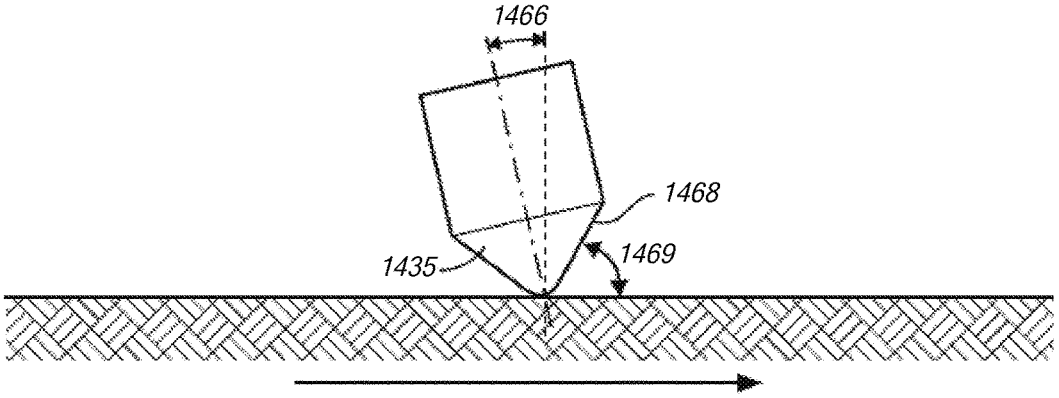
FIG. 14 is a side view of a cutting element having a strike angle, according to at least one embodiment of the present disclosure.

In addition to the orientation of the axis with respect to the formation, the aggressiveness of pointed or other non-planar cutting elements may also be dependent on the apex angle or specifically, the angle between the formation and the leading portion of the non-planar cutting element. Because of the cutting end shape of the non-planar cutting elements, there does not exist a leading edge as found in a planar/shear cutting element; however, the leading line of a non-planar cutting surface may be determined to be the first points of the non-planar cutting element at each axial point along the non-planar cutting end surface as the attached body (e.g., blade of a bit) rotates around a tool axis. Said in another way, a cross-section may be taken of a non-planar cutting element along a plane in the direction of the rotation of the tool, as shown in FIG. 14. The leading line 1468 of the pointed cutting element 1435 in such plane may be considered in relation to the formation. The strike angle of a pointed cutting element 1435 is defined to be the angle 1469 formed between the leading line 1468 of the pointed cutting element 1435 and the formation (or other workpiece) being cut. The angle 1469 may be affected by the geometry of the cutting element 1435, the back rake angle 1466, the orientation of the cutting element on the blade, or other factors.

For polycrystalline diamond compact cutting elements (e.g., shear cutters), side rake is conventionally defined as the angle between the cutting face and the radial plane of the downhole tool (x-z plane). Non-planar cutting elements do not have a planar cutting face and thus the orientation of pointed cutting elements should be defined differently. In the context of a non-planar cutting element such as the pointed cutting elements 1535, shown in FIGS. 15-1 to 16-3, side rake is defined as the angle 1570 formed between the axis of the cutting element 1535 (specifically, the axis of the conical cutting end in the illustrated embodiment) and a line perpendicular to the tool centerline. Side rake may be defined in other manners. For instance, side rake could be defined as an angle formed between the axis of the cutting element 1535 and a line perpendicular to the tangent of the profile of the blade at the location of the cutting element. In FIGS. 15-1 to 16-3, the z-axis may represent the line perpendicular to the tool centerline or the line perpendicular to the tangent of the blade profile.

Figures 1, 15:
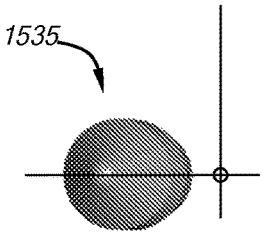
Figures 2, 15:
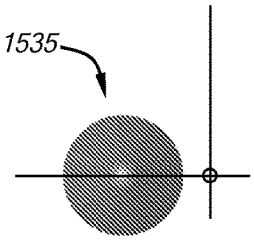
Figures 3, 15:
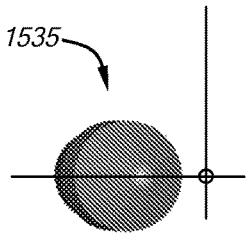
Figures 1, 16:
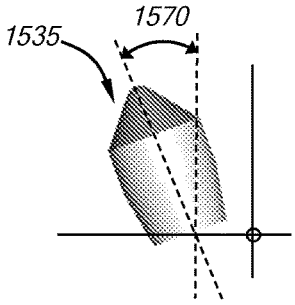
Figures 2, 16:
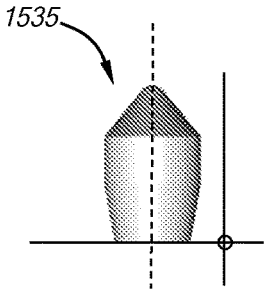
Figures 3, 16:
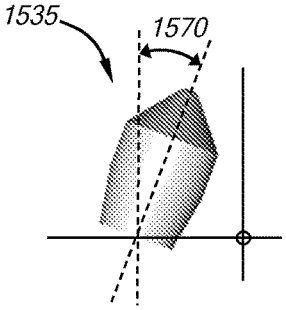

As shown in FIGS. 15-2 and 16-2, with a pointed cutting element 1535 having zero side rake, the axis of the pointed cutting element 1535 is substantially parallel to the z-axis. A pointed cutting element 1535 having negative side rake angle 1570, as shown in FIGS. 15-1 and 16-1 has an axis that is pointed away from the direction of the tool centerline. Conversely, a pointed cutting element 1535 having a positive side rake angle 1570 as shown in FIGS. 15-3 and 16-3 has an axis that points toward the direction of the tool centerline. The side rake of the pointed cutting elements 1535 may, in some embodiments, range between −60° and 60°, between −30° and 30°, between −10° and 10°, or between −5° and 5°. Further, the side rake angle 1570 of non-planar cutting elements may be selected from these or other ranges in embodiments of the present disclosure. In some embodiments, cutting elements on different blades or at different positions (e.g., leading or trailing positions, or at different longitudinal positions in an expansion section) may have the same or different side rake angles and/or back rake angles.

It should be understood that while elements are described herein in relation to depicted embodiments, each element may be combined with other elements of other embodiments. For example, any or each of the planar cutting elements of FIGS. 2 to 7 may be replaced by non-planar cutting elements, or any or each of the non-planar cutting elements of FIGS. 2 to 7 may be replaced by planar cutting elements or by other non-planar cutting elements.

Figure 17:
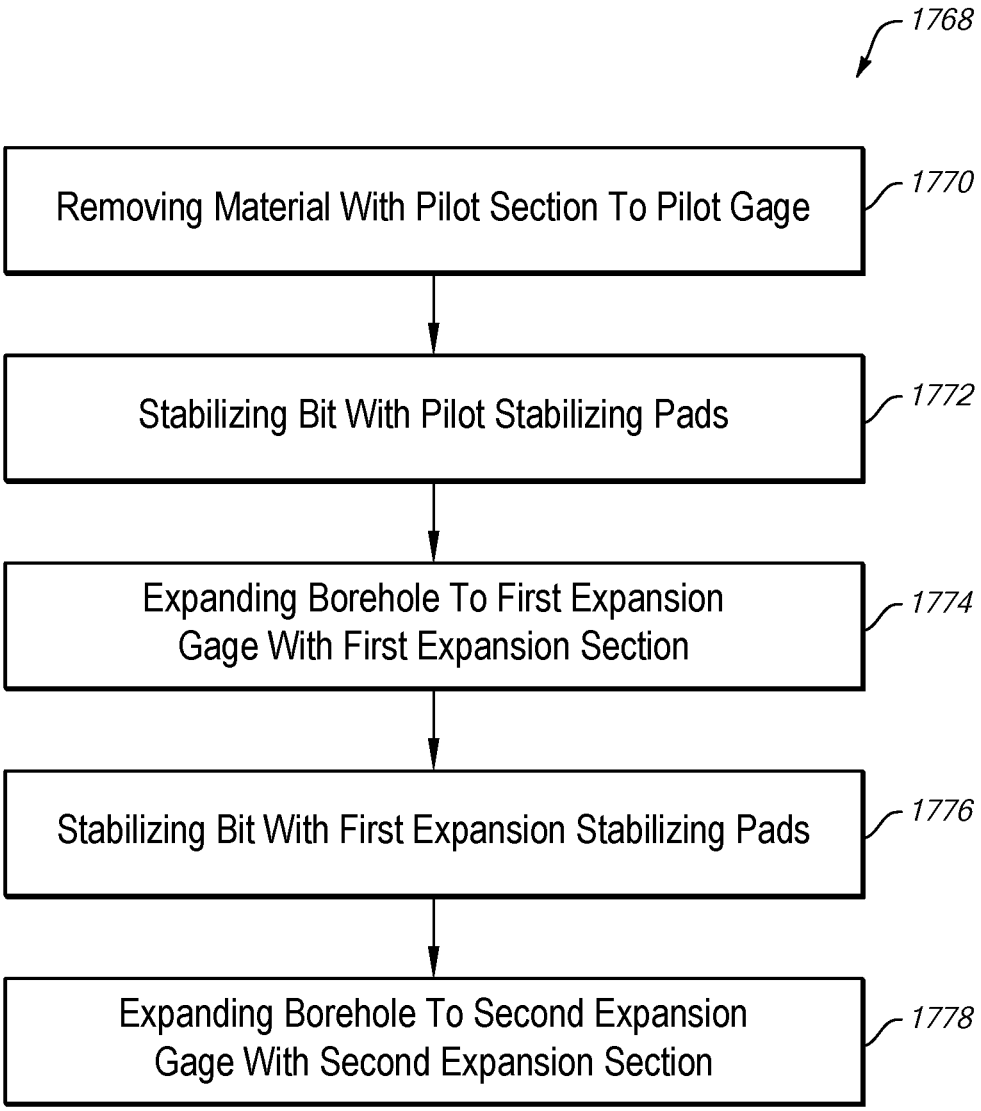
FIG. 17 is a flowchart illustrating a method of removing material with a downhole tool, according to at least one embodiment of the present disclosure.

FIG. 17 is a flowchart of a method 1768 of removing material with a bit, according to embodiments of the present disclosure. In some embodiments, the method 1768 includes removing material with a pilot section of the stepped bit at 1770. The pilot section may create a pilot hole having a pilot diameter. The pilot diameter may be the wellbore gage created by a bit having a pilot radius as described herein. The method 1768 may further include stabilizing the bit with one or more pilot stabilizing pads on the pilot section at 1772. Stabilizing at 1772 may occur before, during, or after expanding a portion of the wellbore from the pilot diameter (or pilot radius) to the first expansion diameter (or first expansion radius) with the first expansion section at 1774. In some embodiments, expanding the wellbore includes failing an unsupported region with the first expansion section toward the pilot section.

The method 1768 may further include stabilizing the stepped bit with first expansion stabilizing pads at 1776. Stabilizing the stepped bit at 1776 may occur before, during, or after expanding a portion of the wellbore from the first expansion diameter/gage (or first expansion radius) to the second expansion diameter/gage (or second expansion radius) with the second expansion section at 1778. In some embodiments, the method 1768 may further include expanding the wellbore beyond the second expansion radius with additional expansion sections and/or stabilizing the bit with one or more expansion stabilizing pads.

At least one embodiment of a stepped bit according to the present disclosure allows the creation of a wellbore with reduced energy as compared to drag bits of comparable radius, by creating and subsequently failing unsupported regions of the formation through which the stepped bit moves, while also stabilizing the bit to reduce lateral and/or axial vibration.

Accordingly, in at least one embodiment, a progressive series of gage pads on the pilot section and subsequently expansion sections reduce and/or limit vibration during drilling. The lower vibration may reduce the risk of damage to the drill bit and/or other components of the BHA or drilling assembly. In some embodiments, the increased stability improves steerability in a formation. In other embodiments, the increased stability improves steerability across formation boundaries. In some embodiments, one or more pilot or expansion gages or stabilizer pads (and potentially a pilot or expansion gage or stabilizer pad on each blade of a bit) include one or more sensors, vibration management actuators, or steering pads or other actuators.

Embodiments of bits have been primarily described with reference to wellbore drilling operations; however, bits of the present disclosure may be used in applications other than the drilling of a wellbore. In other embodiments, stepped bits according to the present disclosure may be used outside a wellbore or other downhole environment used for the exploration or production of natural resources. For instance, stepped bits of the present disclosure may be used in a borehole used for placement of utility lines. Accordingly, the terms "wellbore," "borehole" and the like should not be interpreted to limit tools, systems, assemblies, or methods of the present disclosure to any particular industry, field, or environment.

The articles "a," "an," and "the" are intended to mean that there are one or more of the elements in the preceding descriptions. The term "may" as used herein in connection with one or more features indicates that such elements are included in some embodiments, but are optional for other embodiments within the scope of this disclosure. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that still performs a desired function or achieves a desired result. For example, the terms "approximately," "about," and "substantially" refer to an amount that differs by less than 5% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A downhole tool, comprising a plurality of blades, wherein each blade of the plurality of blades comprises a pilot section, a first expansion section, and a second expansion section:

the pilot section including a plurality of pilot cutting elements, a nose, a cone, and a pilot gage, the pilot gage including at least one pilot stabilizer pad at a pilot radius;

the first expansion section positioned in an uphole longitudinal direction relative to the pilot section, the first expansion section including a plurality of first expansion cutting elements and a first expansion gage, the first expansion gage including at least one first expansion stabilizer pad at a first expansion radius greater than the pilot radius; and the second expansion section positioned in the uphole longitudinal direction relative to the first expansion section, the second expansion section including a plurality of second expansion cutting elements and a second expansion gage having a second expansion radius greater than the first expansion radius.

2. The downhole tool of claim 1, the pilot radius being between 70% and 95% of the second expansion radius.

3. The downhole tool of claim 1, the second expansion section including at least one second expansion stabilizer pad at the second expansion radius.

4. The downhole tool of claim 1, at least one of the first or second expansion cutting elements being a non-planar cutting element.

5. The downhole tool of claim 1, at least one of the first or second expansion cutting elements having a cutting element longitudinal axis oriented between 35° and 65° relative to a longitudinal axis of the downhole tool.

6. The downhole tool of claim 1, at least one of the first or second expansion cutting elements having a cutting element included angle between 65° and 100°.

7. The downhole tool of claim 1, at least one of the first or second expansion cutting elements including a cutting end, an outer radial side surface of the cutting end oriented at an alignment angle of 0.2° to 5° relative to the uphole longitudinal direction.

8. The downhole tool of claim 1, the first expansion radius being between 5% and 25% larger than the pilot radius, and the second expansion radius being between 5% and 25% larger than the first expansion radius.

9. The downhole tool of claim 1, further comprising a bit breaker section longitudinally between the first and second expansion sections.

10. A drill bit, comprising a plurality of blades extending longitudinally along the drill bit through a pilot section, a first expansion section, and a second expansion section, wherein:

the pilot section including a plurality of pilot cutting elements having a pilot cutting radius, the pilot section further including a nose, a cone, and at least one pilot stabilizer pad;

the first expansion section having a plurality of first expansion cutting elements on a first expansion surface and defining a first expansion cutting radius greater than the pilot cutting radius, the first expansion section further including at least one first expansion stabilizer pad; and the second expansion section having a plurality of second expansion cutting elements on a second expansion surface and defining a second expansion cutting radius greater than the first expansion cutting radius, the second expansion being section being coupled to the first expansion section and the pilot section, such that the first expansion section is longitudinally between the pilot section and the second expansion section wherein each blade of the plurality of blades comprises a leading surface, an opposing trailing surface, and a top surface extending between the leading and trailing surfaces and extending longitudinally along the drill bit through the pilot section, the first expansion section, and the second expansion section along the respective blade.

11. The drill bit of claim 10, the pilot cutting radius being between 85% and 97.5% of the first expansion cutting radius and between 70% and 95% of the second expansion cutting radius.

12. The drill bit of claim 10, at least a portion of the at least one pilot stabilizer pad or first expansion stabilizer pad being non-parallel to a longitudinal axis of the drill bit.

13. The drill bit of claim 10, the plurality of first expansion cutting elements, the plurality of second expansion cutting elements, or both the pluralities of first and second expansion cutting elements including at least one planar cutting element and at least one non-planar cutting element.

14. The drill bit of claim 10, at least two cutting elements of the plurality of first expansion cutting elements or at least two cutting elements of the plurality of second expansion cutting elements having cutting tips at different radial positions.

15. The drill bit of claim 10, at least two cutting elements of the plurality of first expansion cutting elements or at least two cutting elements of the plurality of second expansion cutting elements having cutting tips at different longitudinal positions.

16. A method of removing material using a downhole tool, wherein the downhole tool comprises a plurality of blades extending longitudinally along the downhole tool through a pilot section, a first expansion section, and a second expansion section, wherein at least one blade of the plurality of blades comprises a top surface extending between a leading surface and a trailing surface of the at least one blade, wherein the top surface extends longitudinally along the drill bit through the pilot section, the first expansion section, and the second expansion section, the method comprising:

removing material in a formation with a nose and a cone of the pilot section of the downhole tool to create a pilot hole having a pilot radius;

stabilizing the downhole tool in the pilot hole with at least one pilot stabilizer pad positioned on a pilot gage of the pilot section, wherein the at least one pilot stabilizer pad forms a first portion of the top surface of the at least one blade;

expanding the pilot hole to a first expansion radius with one or more cutting elements on a second portion of the top surface of the first expansion section of the at least one blade of the downhole tool;

stabilizing the downhole tool with at least one first expansion stabilizer pad positioned on a first expansion gage of the first expansion section, wherein the at least one first expansion stabilizer pad forms a third portion of the top surface of the at least one blade; and expanding the first expansion radius to a second expansion radius with one or more cutting elements on a fourth portion of the top surface of the second expansion section of the at least one blade of the downhole tool, the pilot radius being between 75% and 95% of the second expansion radius.

17. The method of claim 16, further comprising:

stabilizing the downhole tool with at least one second expansion stabilizer pad positioned on a second expansion gage of the second expansion section.

18. The method of claim 16, comprising:

expanding the pilot hole including failing an unsupported region of the formation toward a longitudinal axis of the downhole tool; and expanding the first expansion radius including failing an unsupported region of the formation toward a longitudinal axis of the downhole tool.

19. The method of claim 16, further comprising at least one of:

steering the drill bit using one or more actuators in at least one of the stabilizer pads;

managing vibration of the drill bit using one or more actuators in at least one of the stabilizer pads; or sensing one or more parameters of the downhole tool, the formation, the pilot hole, or materials within the pilot hole using one or more sensors in at least one of the stabilizer pads.

* * * * *